US012644382B2

(12) United States Patent
Cramer

(10) Patent No.: US 12,644,382 B2
(45) Date of Patent: Jun. 2, 2026

(54) HYDRAULIC INTEGRITY ANALYSIS

(71) Applicant: CONOCOPHILLIPS COMPANY, Houston, TX (US)

(72) Inventor: David D. Cramer, Houston, TX (US)

(73) Assignee: CONOCOPHILLIPS COMPANY, Houston, TX (US)

( * ) Notice: Subject to any disclaimer, the term of this patent is extended or adjusted under 35 U.S.C. 154(b) by 53 days.

(21) Appl. No.: 18/657,136

(22) Filed: May 7, 2024

(65) Prior Publication Data

US 2024/0287899 A1 Aug. 29, 2024

Related U.S. Application Data

(63) Continuation of application No. 17/577,848, filed on Jan. 18, 2022, now Pat. No. 12,006,819.

(60) Provisional application No. 63/138,138, filed on Jan. 15, 2021.

(51) Int. Cl.

| | |
|---|---|
| ***E21B 49/00*** | (2006.01) |
| ***E21B 33/12*** | (2006.01) |
| ***E21B 43/116*** | (2006.01) |
| ***E21B 47/06*** | (2012.01) |
| *E21B 43/26* | (2006.01) |

(52) U.S. Cl.

CPC ..... *E21B 49/008* (2013.01); *E21B 33/12* (2013.01); *E21B 43/116* (2013.01); *E21B 47/06* (2013.01); *E21B 43/26* (2013.01)

(58) Field of Classification Search

CPC ..... E21B 49/008; E21B 33/12; E21B 43/116; E21B 47/06

See application file for complete search history.

(56) References Cited

U.S. PATENT DOCUMENTS

| | | | |
|---|---|---|---|
| 9,988,895 | B2 | 6/2018 | Roussel et al. |
| 10,408,054 | B2 | 9/2019 | Paul |
| 10,458,228 | B2 | 10/2019 | Jin et al. |
| 10,753,181 | B2 | 8/2020 | Roussel |
| 10,801,307 | B2 | 10/2020 | Roussel et al. |
| 10,808,521 | B2 | 10/2020 | Friehauf |
| 11,209,558 | B2 | 12/2021 | Roussel |

(Continued)

OTHER PUBLICATIONS

Weijers, Leen, et al—"Trends in the North American Frac Industry: Invention through the Sale Revolution", 1994, SPE International, SPE-194345-MS, SPE Hydraulic Fracturing Technology Conference and Exhibition held in The Woodlands, TX Feb. 5-7, 2019; 22 pgs.

(Continued)

*Primary Examiner* — Catherine Loikith

(57) ABSTRACT

An economical process in which cement sheath integrity, perforation cluster spacing and frac plug integrity can be assessed for every frac stage, potentially leading to improvements in stimulation, completion, cementing and drilling practices. It is based on analyzing wellbore pressure responses occurring at key segments of the wireline pump-down and perforating operation and correlating the results among multiple frac stages and wells in a field or play. A special requirement is that the frac ball (ball check) is inserted in the frac plug and pumped to seat prior to performing perforating operations. A complementary benefit of this process is that selectively establishing injectivity in the most distant perforation cluster can be used to establish inhibited HCl acid (wireline acid) coverage across all perforation intervals for uniform reduction in near-wellbore tortuosity.

7 Claims, 13 Drawing Sheets

Plug-and-perf method of stimulating multiple intervals in a horizontal well (Stonewall Engineering)

(56) References Cited

U.S. PATENT DOCUMENTS

| | | | |
|---|---|---|---|
| 2005/0178551 | A1 | 8/2005 | Tolman et al. |
| 2015/0176386 | A1 | 6/2015 | Castillo et al. |
| 2015/0356403 | A1 | 12/2015 | Storm, Jr. |
| 2018/0148999 | A1 | 5/2018 | Roussel |
| 2018/0364381 | A1 | 12/2018 | Raterman et al. |
| 2019/0120047 | A1 | 4/2019 | Jin et al. |
| 2019/0129047 | A1 | 5/2019 | Clark et al. |
| 2019/0346579 | A1 | 11/2019 | Roussel et al. |
| 2020/0309982 | A1 | 10/2020 | Jin et al. |

OTHER PUBLICATIONS

Ugueto, Gustavo, et al—"New Near-Wellbore Insights from Fiber Optics and Downhole Pressure Gauge Data", 2019, SPE International, SPE-194371-MS, Hydraulic Fracturing Technology Conference and Exhibition held in The Woodlands, TX Feb. 5-7, 2019; 12 pgs.

Cramer, et al—"Integrating Distributed Acoustic Sensing, Treatment-Pressure Analysis, and Video-Based Perforation Imaging To Evaluate Limited-Entry-Treatment Effectiveness" 2020, SPE 194334-PA; SPE Production & Operations vol. 35, Issue No. 4, pp. 0730-0755; 26 pgs.

Walker, K., et al—"Engineered Perforation Design Improves Fracture Placement and Productivity in Horizontal Shale Gas Wells", 2012, SPE International, SPE 154582, Americas Unconventional Resources Conference held in Pittsburgh, PA Jun. 5-7, 2012; 7 pgs.

Weijers, L., et al—"Geometry of Hydraulic Fractures Induced From Horizontal Wellbores", 1994, SPE Production & Facilities, May 1994; 6 pgs.

Wright, C.A., et al—Wellbore-to-Fracture Communication Problems Pose Challenges in California Diatomite Horizontal Wells, 1997, SPE International, SPE 38632, SPE Annual Technical Conference and Exhibition held in San Antonio, TX Oct. 5-8, 1997; 13 pgs.

Ugueto, Gustavo A., et al—Perforation Cluster Efficiency of Cemented Plug and Perf Limited Entry Completions; Insights from Fiber Optics Diagnostics, 2016, SPE International, SPE-179124, Hydraulic Fracturing Technology Conference held in The Woodlands, Texas Feb. 9-11, 2016; 17 pgs.

Zhang, Shuang, et al—2017, "Inversion of Downhole Temperature Measurements in Multistage-Fracturing Stimulation of Horizontal Wells in Unconventional Reservoirs", SPE Production & Operations, May 2020, SPE 178322 accepted at the SPE Annual Technical Conference and Exhibition, San Antonio, TX Oct. 9-11, 2017; 14 pgs.

Leonard, R.S., et al, "Refracs-Diagnostics Provide a Second Chance to Get it Right", 2015, SPE 174979-MS, SPE Annual Technical Conference and Exhibition, Houston TX Sep. 28-30, 2015; 33 pgs.

Robinson, Stephen, et al—"Acoustic Imaging of Perforation Erosion in Hydraulically Fractured Wells for Optimizing Cluster Efficiency", 2020, SPE International, SPE-199718-MS, Hydraulic Fracturing Technology Conference and Exhibition held in The Woodlands, TX Feb. 4-6, 2020; 51 pgs.

Mcclure, M., et al, A Collaborative Study on DFIT Interpretation: Integrating Modeling, Field Data, and Analytical Techniques, 2019, Unconventional Resources Technology Conference, URTeC: 123; Denver, CO Jul. 22-24, 2019; 39 pgs.

Cramer, D., et al—"Diagnostic Fracture Injection Testing Tactics in Unconventional Reservoirs", 2013, SPE International, SPE 163863; 43 pgs.

Nguyen, D., et al—"Practical Applications of Water Hammer Analysis from Hydraulic Fracturing Treatments", 2021, SPE International, SPE-204154-MS, Hydraulic Fracturing Technology Conference and Exhibition May 4-6, 2021; 47 pgs.

Holzhausen, G.R., et al—"Impedance of Hydraulic Fractures: Its Measurement and Use for Estimating Fracture Closure Pressure and Dimensions", 1985, Society of Petroleum Engineers and U.S. Department of Energy; SPE/DOE 13892, 12 pgs.

Ghidaoui, et al—"A Review of Water Hammer Theory and Practice", 2005, Applied Mechanics Reviews, vol. 58, pp. 49-76; 28 pgs.

Haut, R., et al—"Primary Cementing: The Mud Displacement Process", 1979, 54th Annual SPE Fall Technical Conference and Exhibition, Las Vegas, NV Sep. 23-26, SPE 8253; 12 pgs.

Roark, Abigail, et al—"The Use of Pump Down Pressure Responses to Diagnose Hydraulic Fracture Characteristics", 2017, URTeC: 2669994, URTeC Conference held in Austin, TX Jul. 24-26, 2017; 16 pgs.

Salah, Mohamed, et al—"Evaluation of Multistage Fracturing Stimulation Horizontal Well Completion Methods in Western Desert, Egypt", 2017, SPE International, SPE-183785-MS, Middle East Oil & Gas Show and Conference held in Manama, Bahrain, Mar. 6-9, 2017; 22 pgs.

Walton, Zachary, et al—"Frac Plug Pump Down Efficiencies and Techniques", 2019, SPE International, SPE 196210-MS, SPE Annual Technical Conference and Exhibition held in Calgary, Alberta, Canada Sep. 30-Oct. 2, 2019; 8 pgs.

Sneddon, I.N., "The distribution of stress in the neighbourhood of a crack in an elastic solid", 1946, Royal Society Publishing, pp. 229-260; 32 pgs.

Cramer, David, et al—"Pump-down Diagnostics for Plug-and-Perf Treatments", 2020, SPE0201376-MS, Society of Petroleum Engineers; 23 pgs.

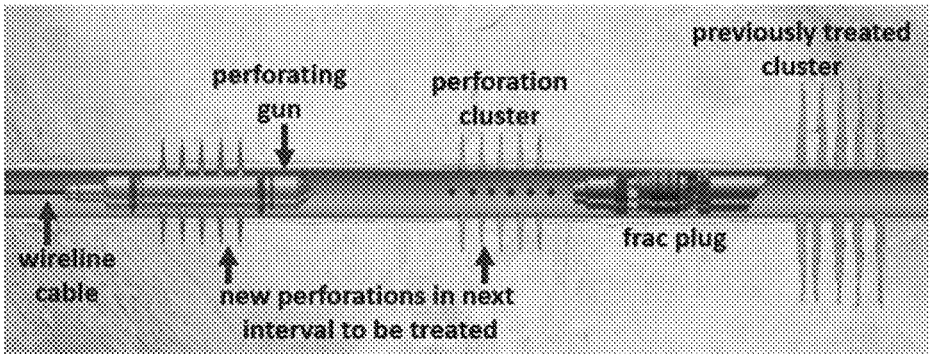
Figure 1. Plug-and-perf method of stimulating multiple intervals in a horizontal well (Stonewall Engineering)
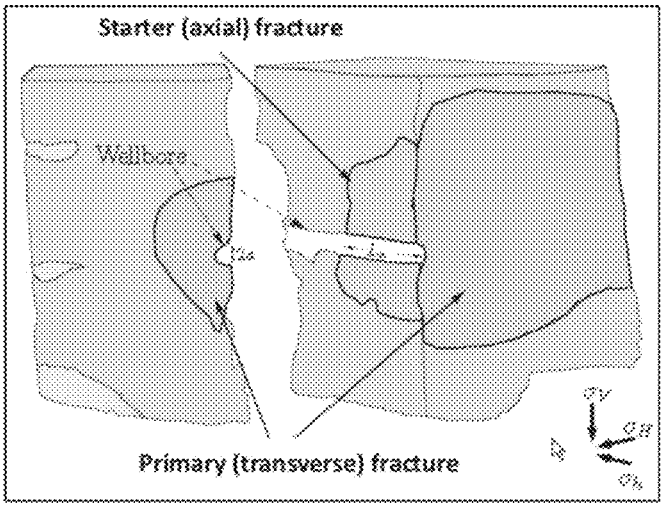
Figure 2. Longitudinal starter fracture increases the breadth of fracturing along the lateral (Weijers et al 1994)

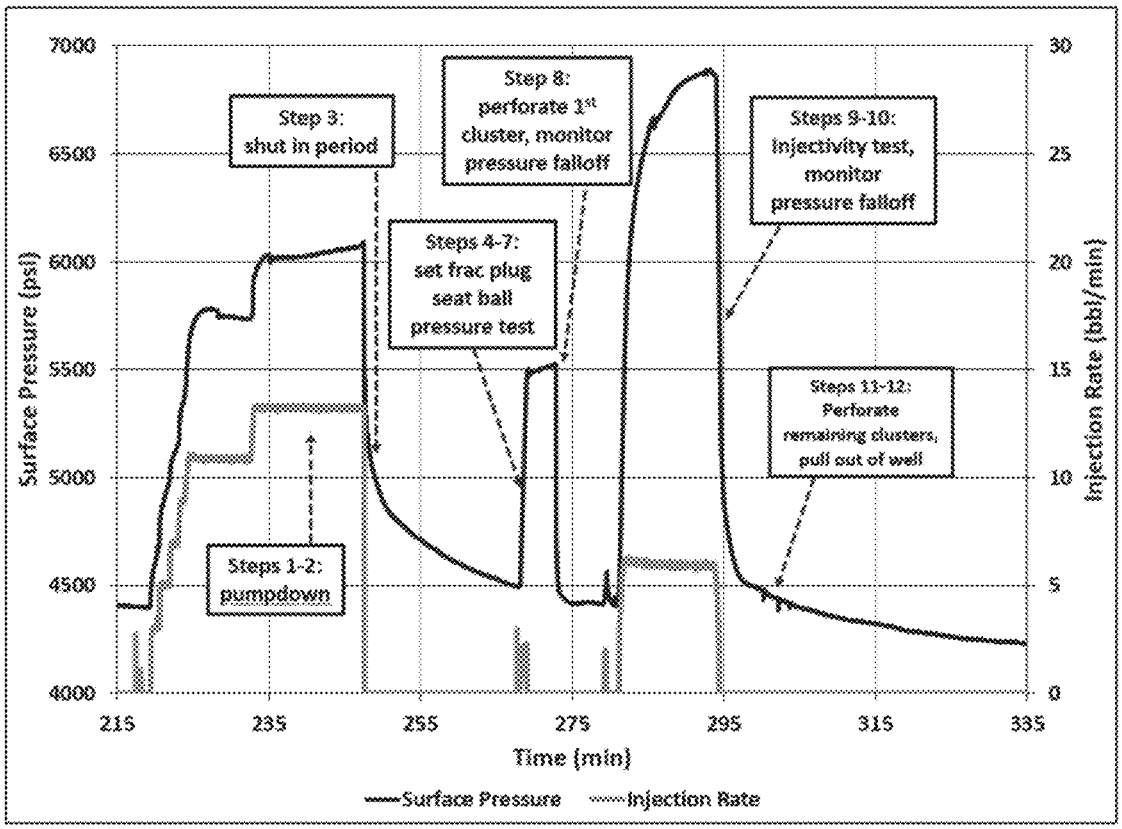
Figure 3. Pump-down diagnostics and establishing selective injectivity into the first perforation cluster
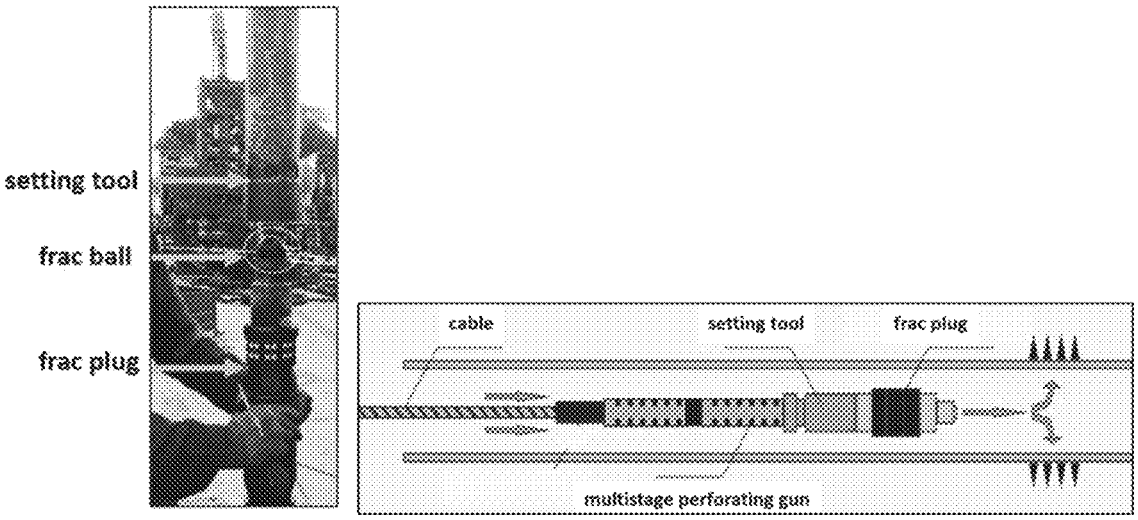
Figure 4. a.) Frac ball (ball check) is pre-installed in plug b.) bottomhole assembly (Salah et al. 2017)

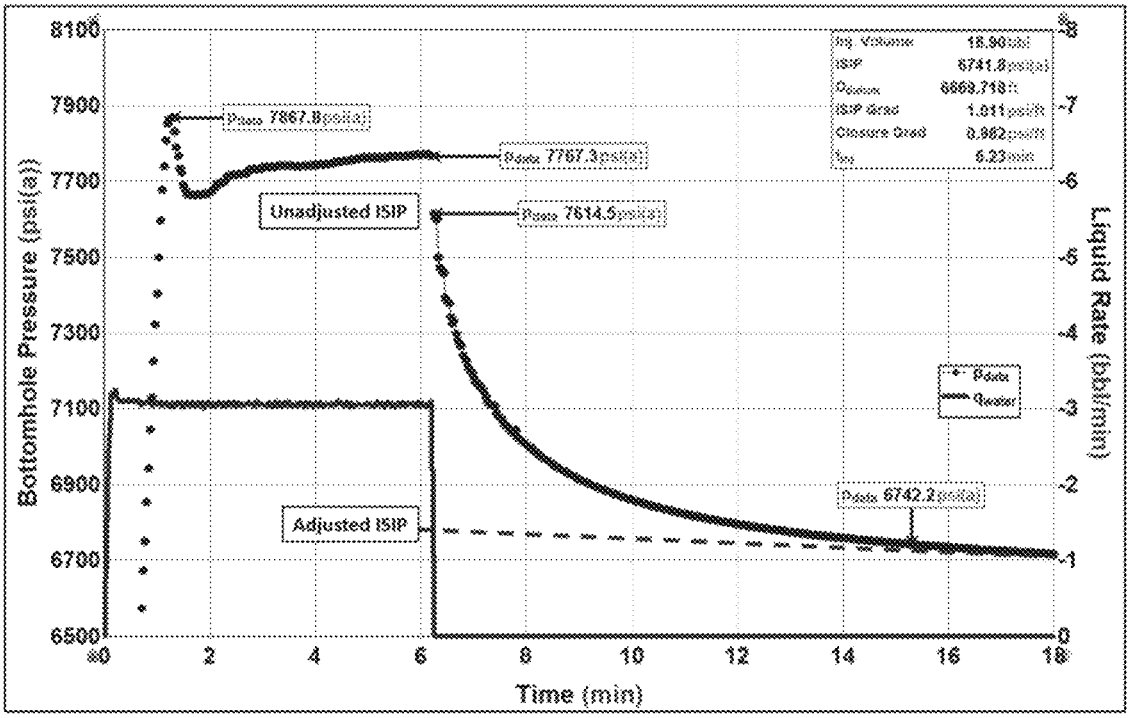
Figure 5. Typical DFIT pressure profile via toe initiation valve in cemented horizontal well
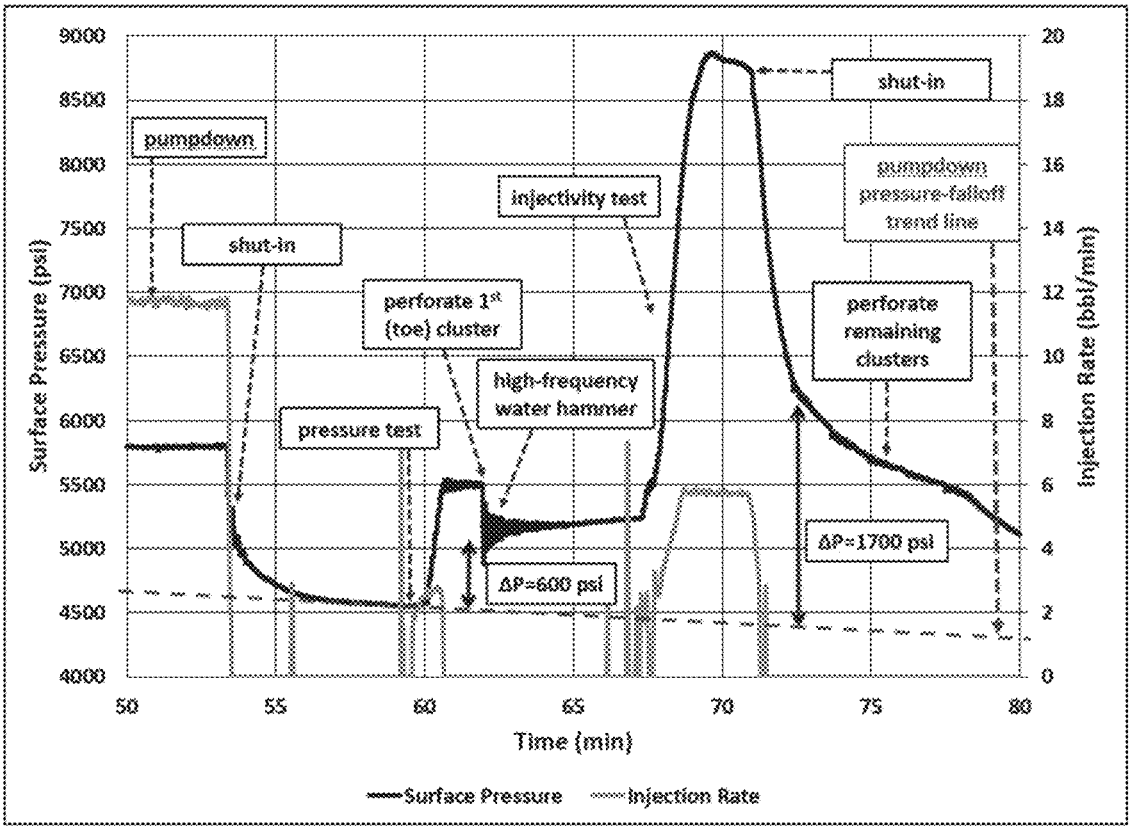
Figure 6. Example of isolation from previously treated intervals

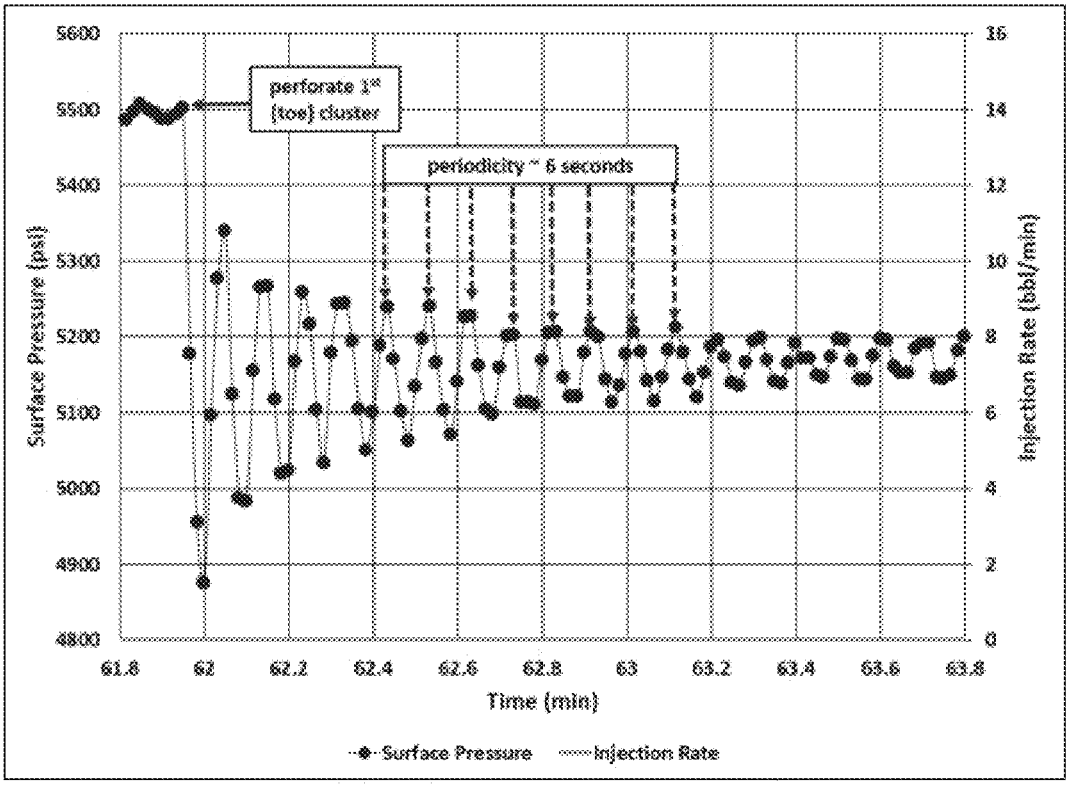
Figure 7. Water hammer oscillations following perforating
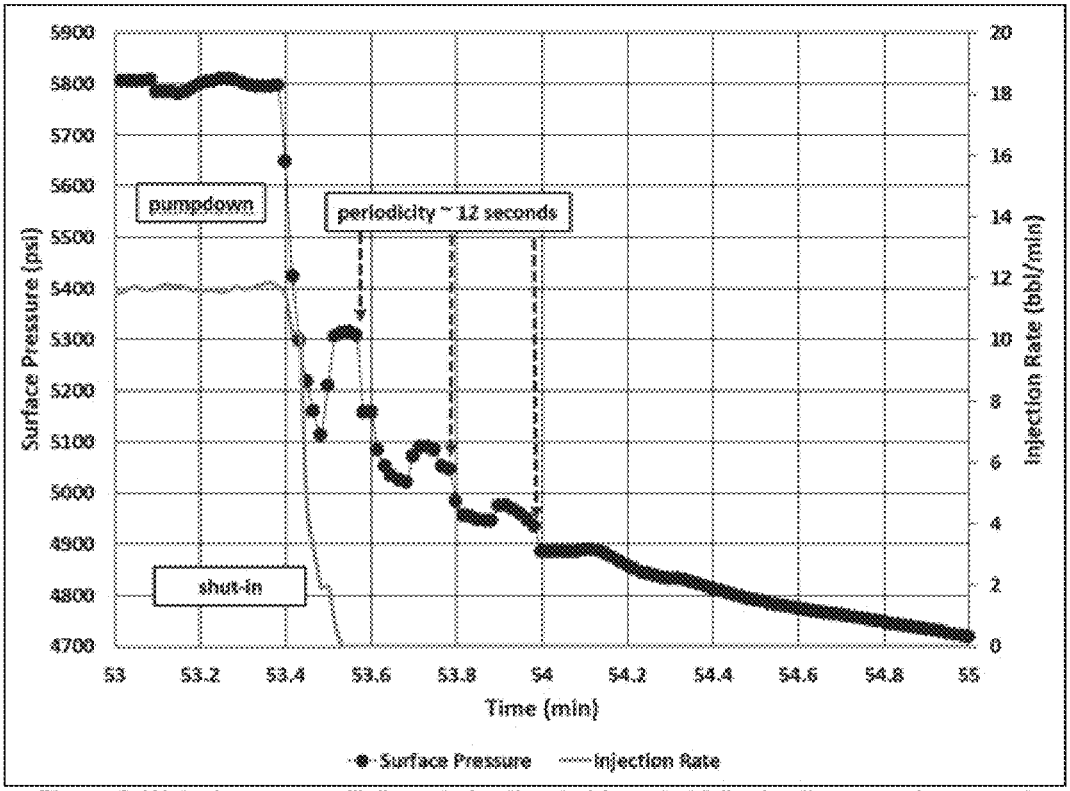
Figure 8. Water hammer oscillations during the shut-in period following the pump-down event

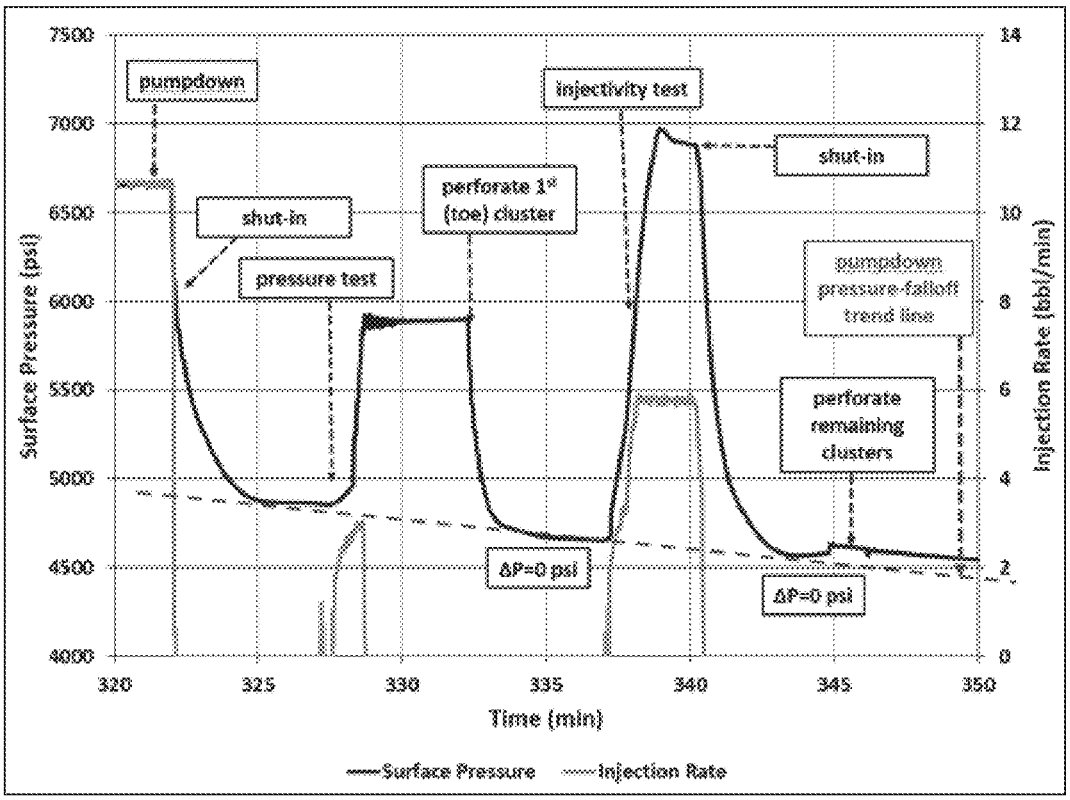
Figure 9. Example of communication to previously treated intervals
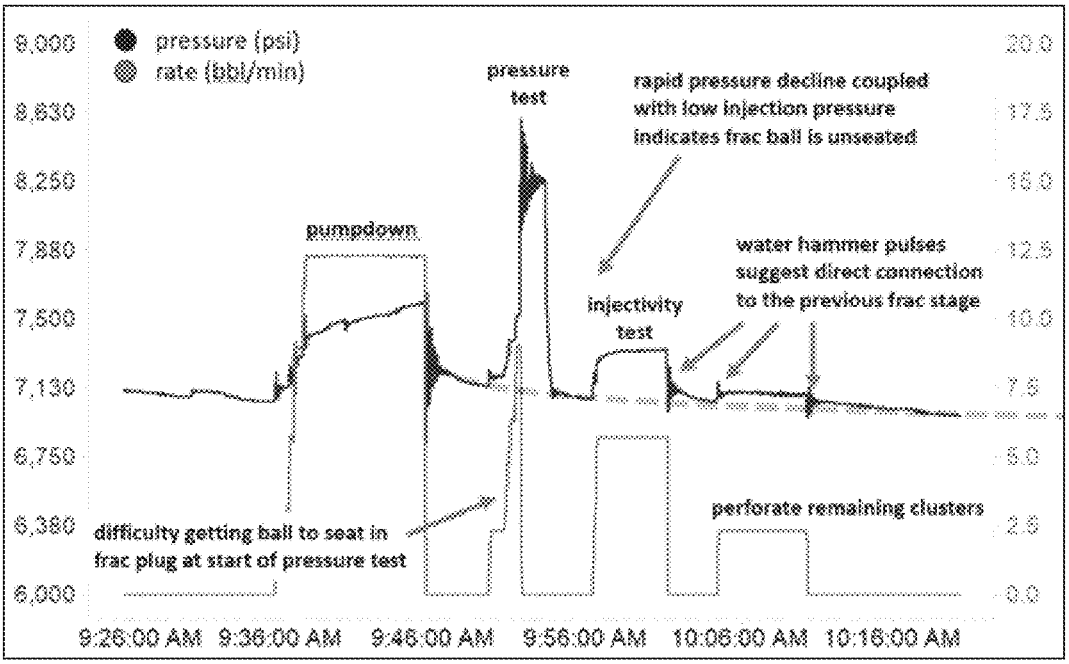
Figure 10. Example of sustained ball seat failure following the perforating event. Dashed line is the pump-down pressure-falloff trend line.

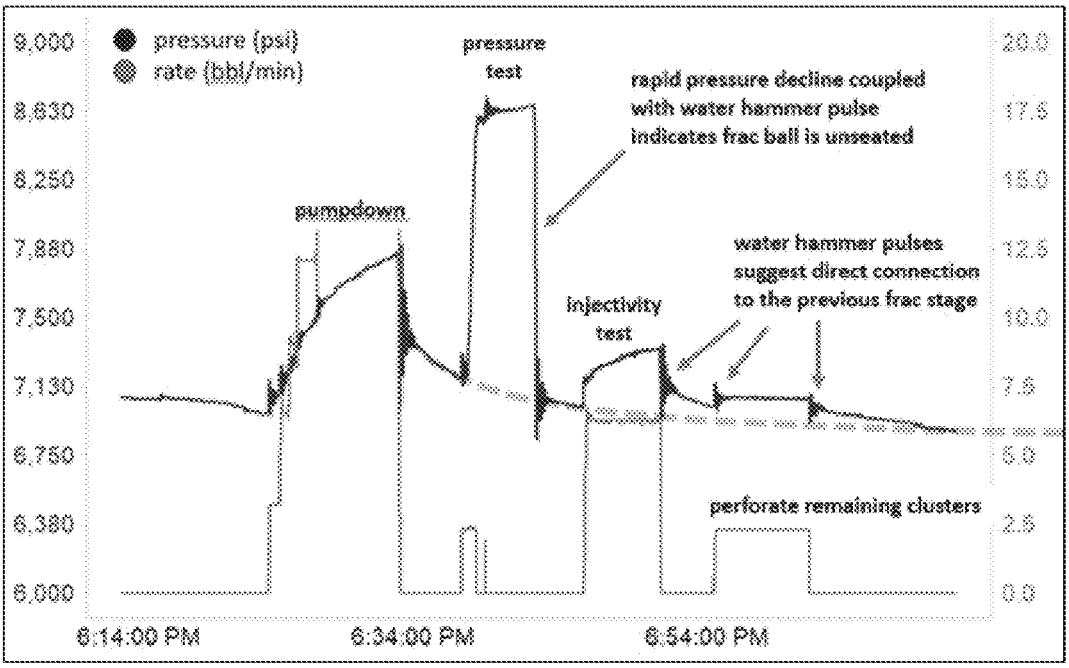
Figure 11. Another example of sustained ball seat failure following the perforating event Dashed line is the pump-down pressure-falloff trend line.
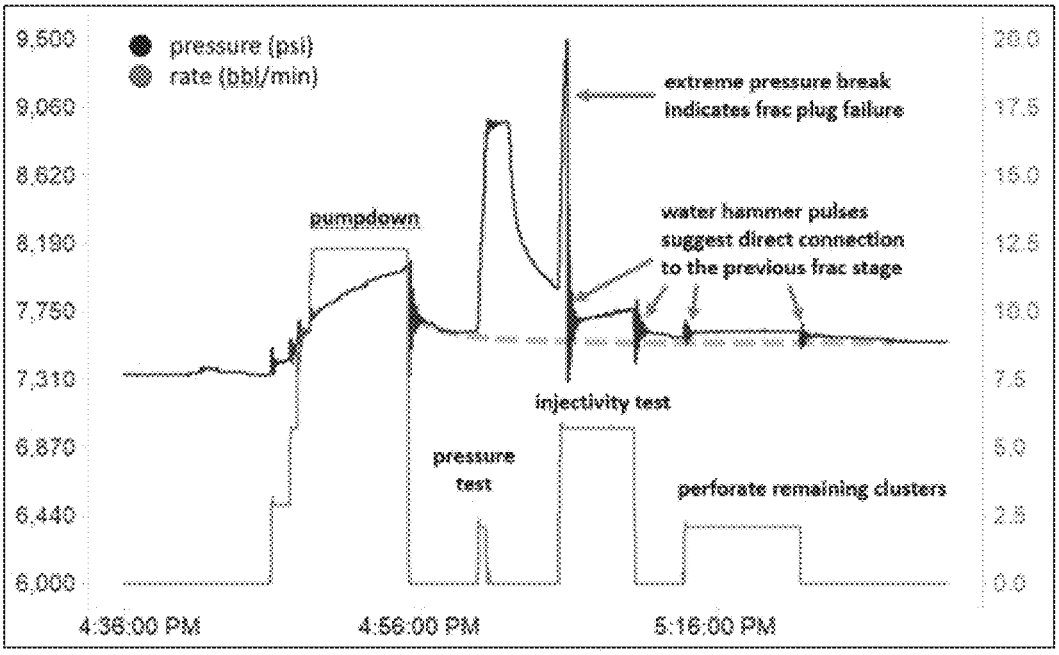
Figure 12. Failure of frac plug during injectivity test. Dashed line is the pump-down pressure-falloff trend line.

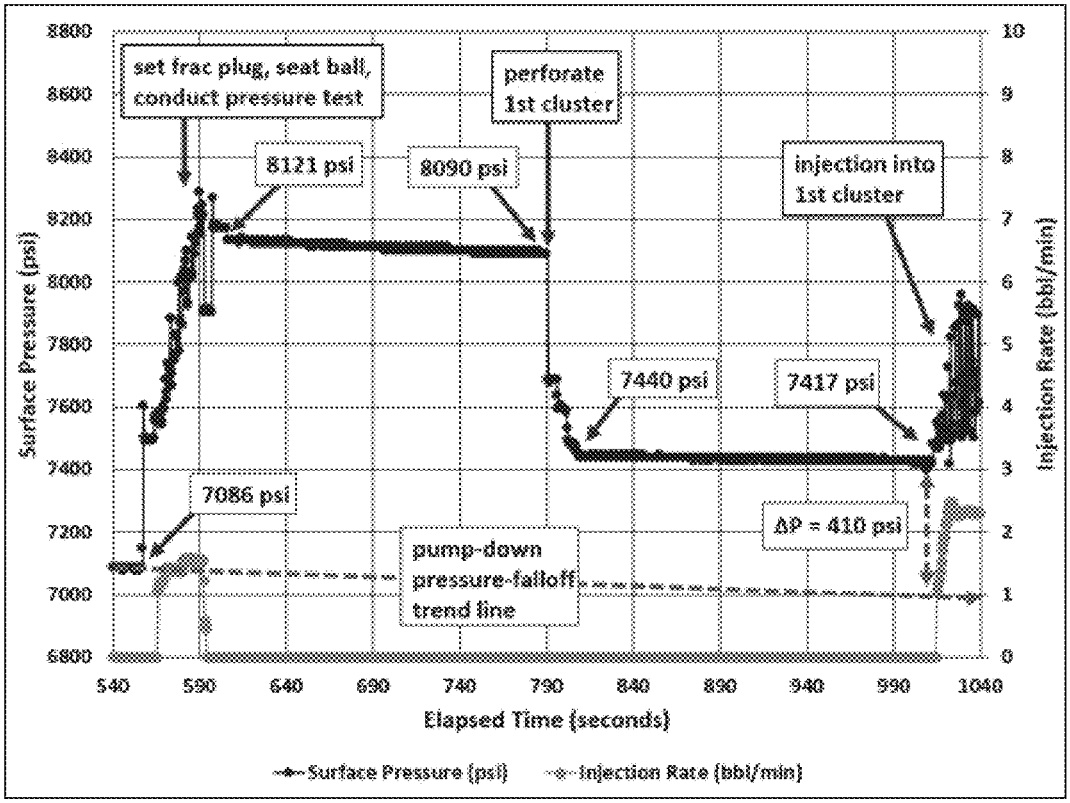
Figure 13. Leak detected during system pressure test
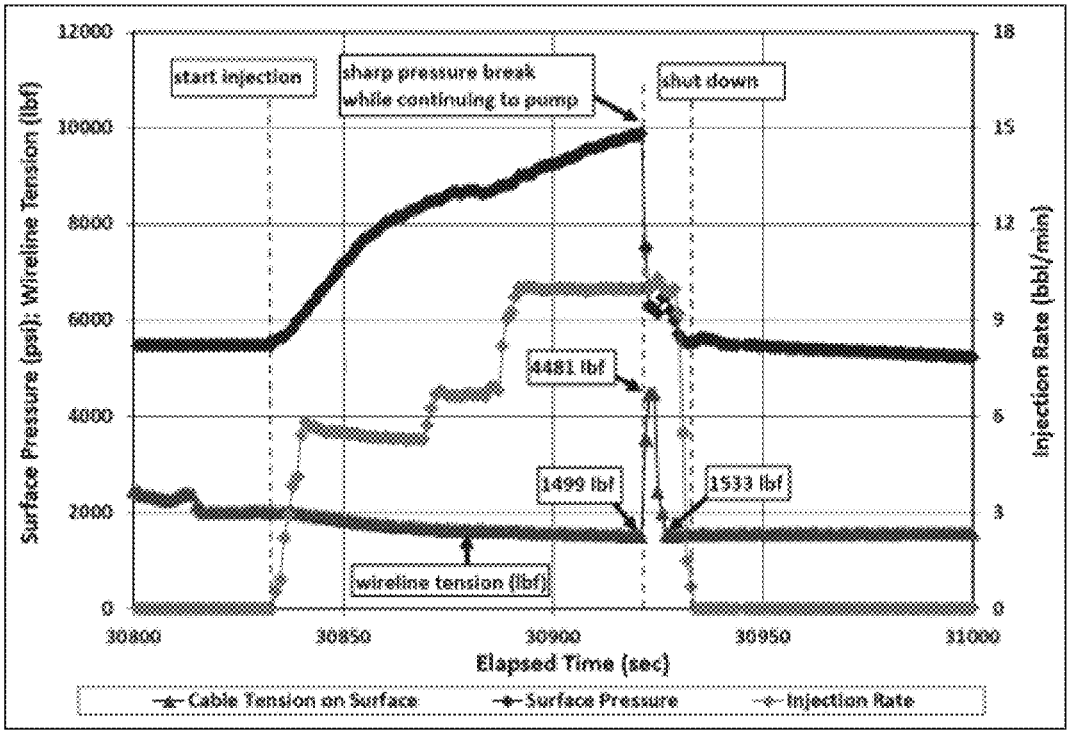
Figure 14. Example of frac plug failure and wireline tension increase during injectivity test

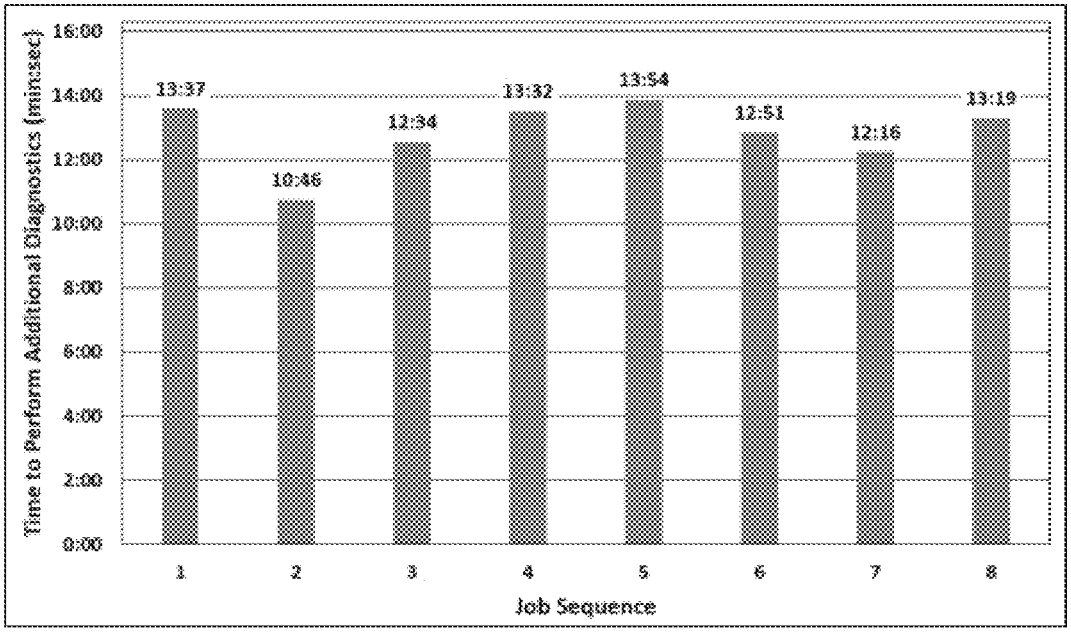
Figure 15. Incremental time to perform pump-down diagnostics
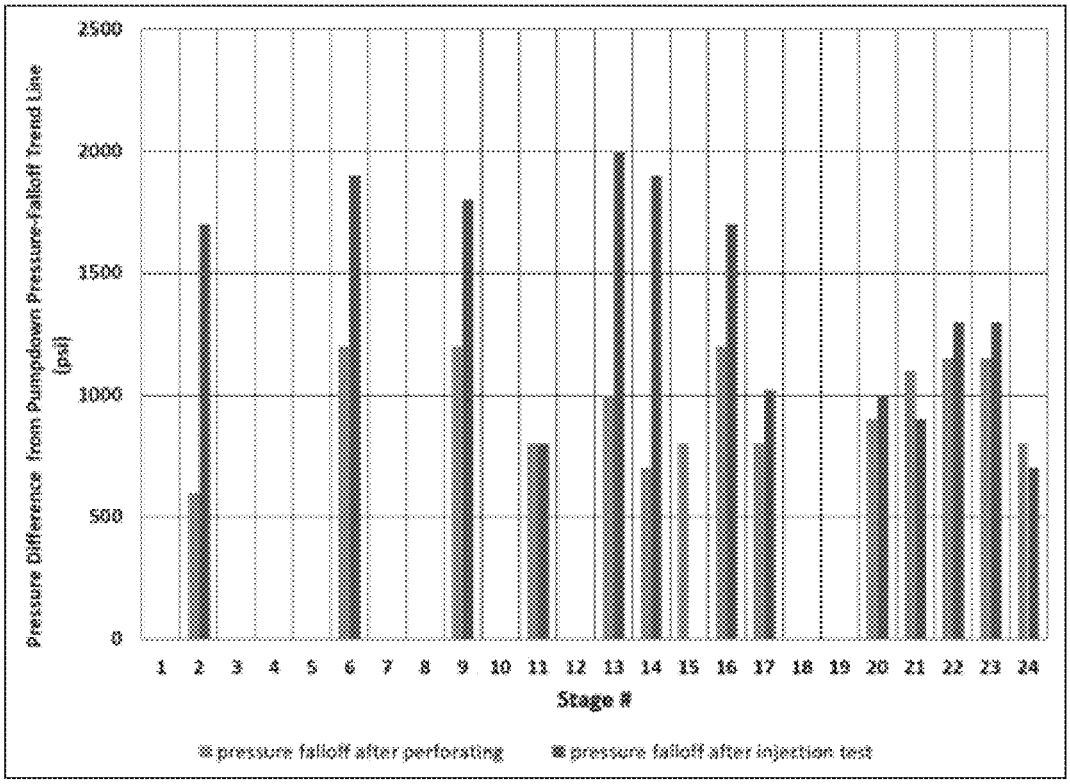
Figure 16. Separation from the pump-down pressure-falloff line - Baltic Basin case study

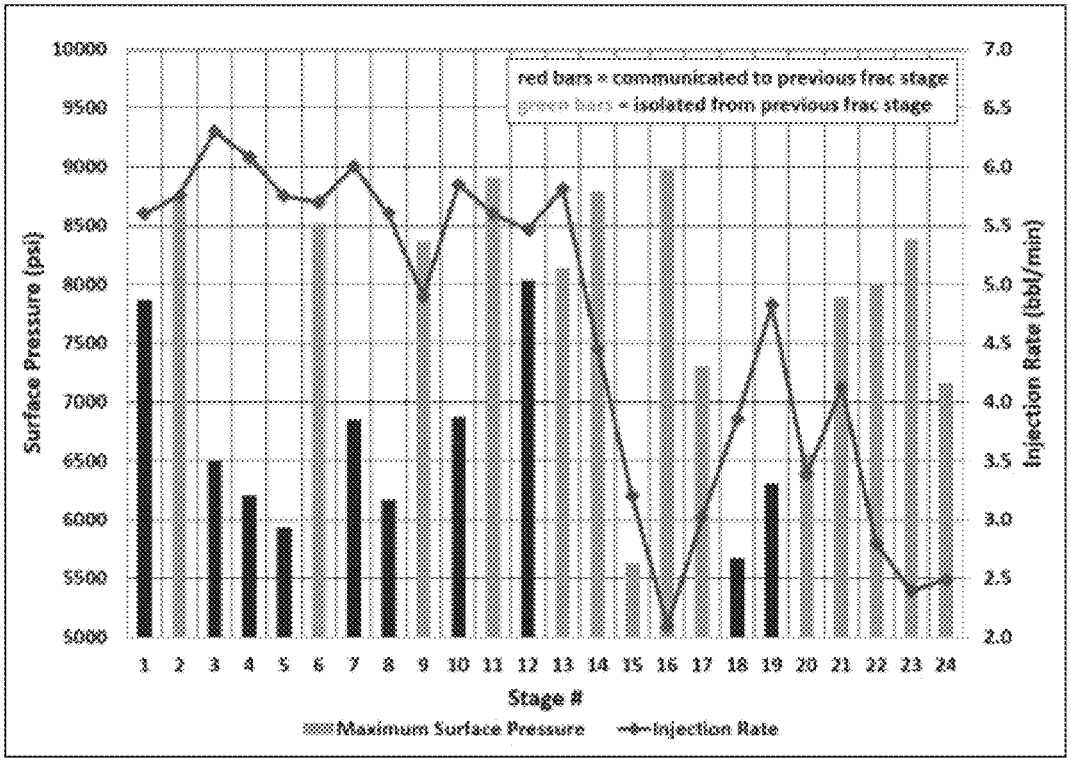
Figure 17. Rate and treating pressure during injectivity test - Baltic Basin case study
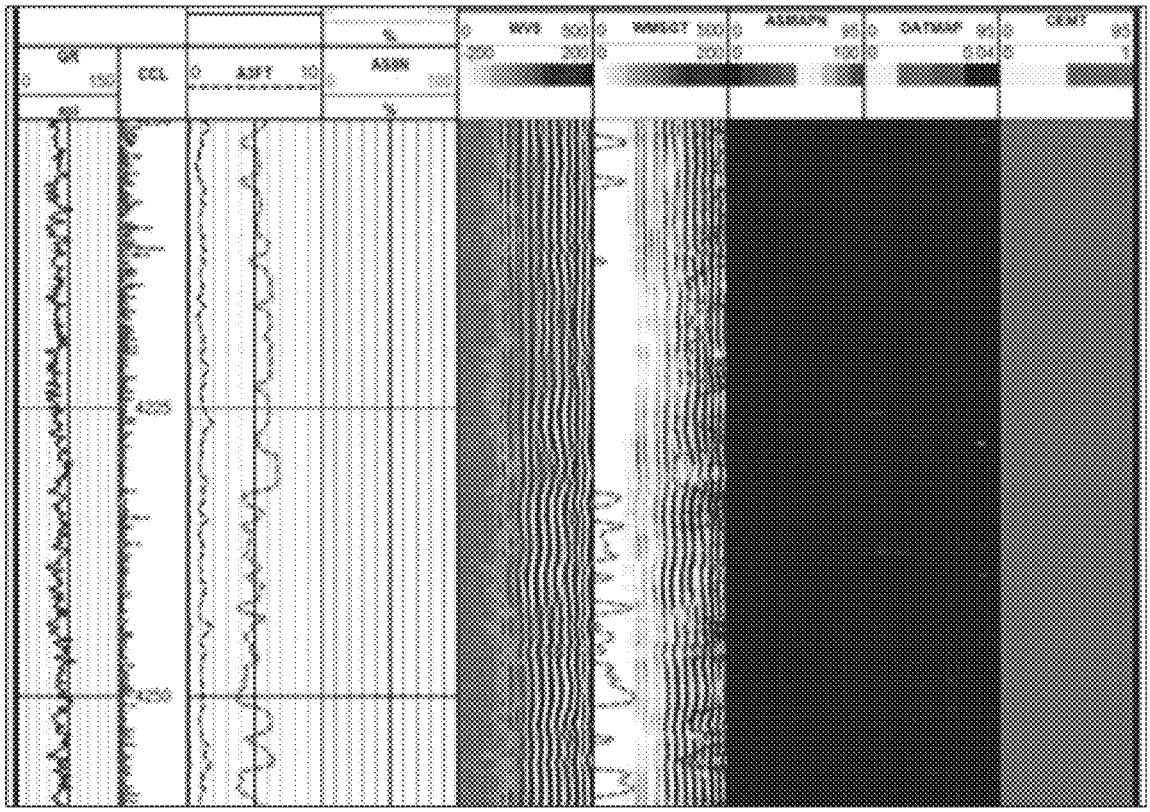
Figure 18. Cement coverage as measured by Radial Bond Tool, in lateral section covered by fracturing stages 4-5

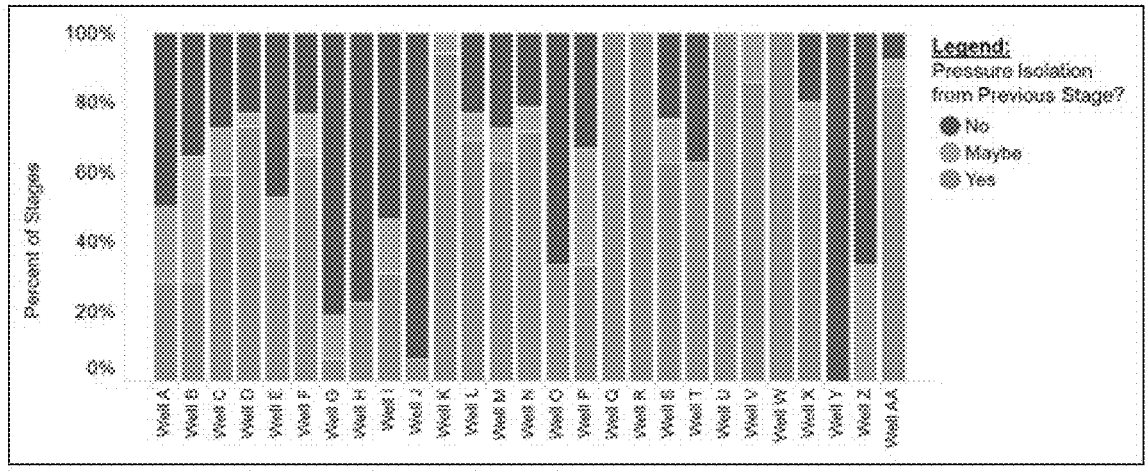
Figure 19. Summary of pump-down diagnostics results on 27 wells
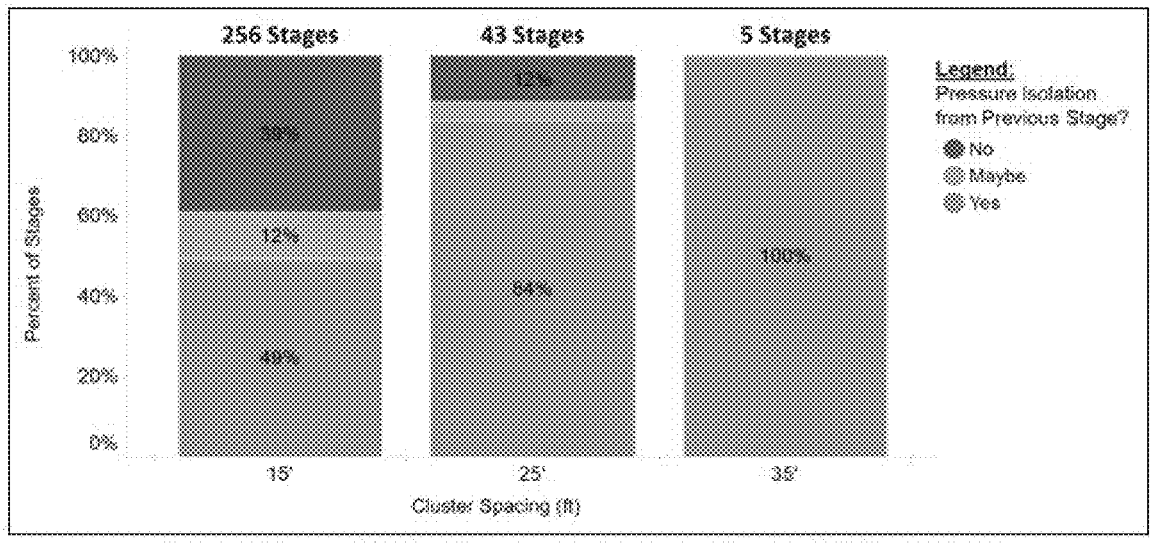
Figure 20. Pressure isolation between stages as a function of cluster spacing distance

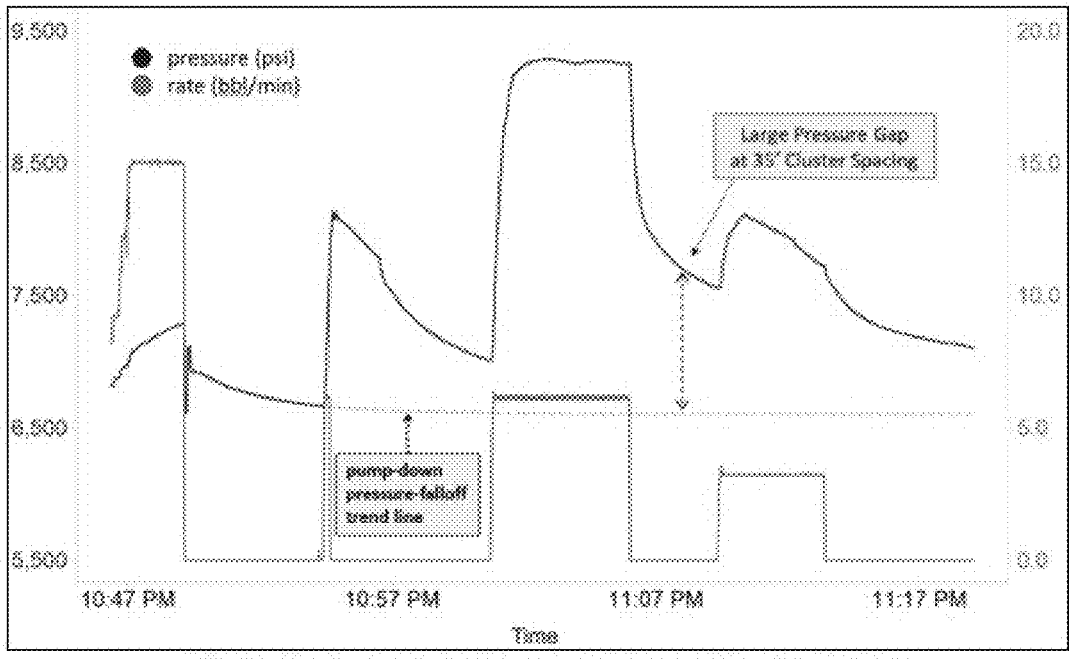
Figure 21. Example of typical pressure behavior during pump-down diagnostics on a fracturing stage at 35 ft (10.7 m) cluster spacing
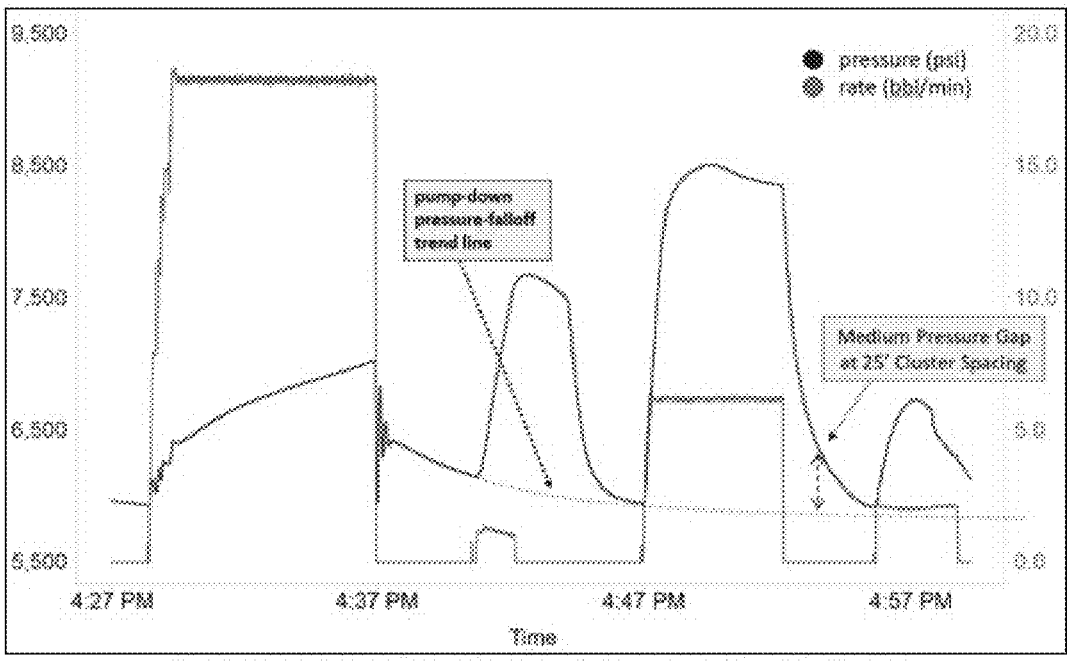
Figure 22. Example of typical pressure behavior during pump-down diagnostics on a fracturing stage at 25 ft (7.6 m) cluster spacing

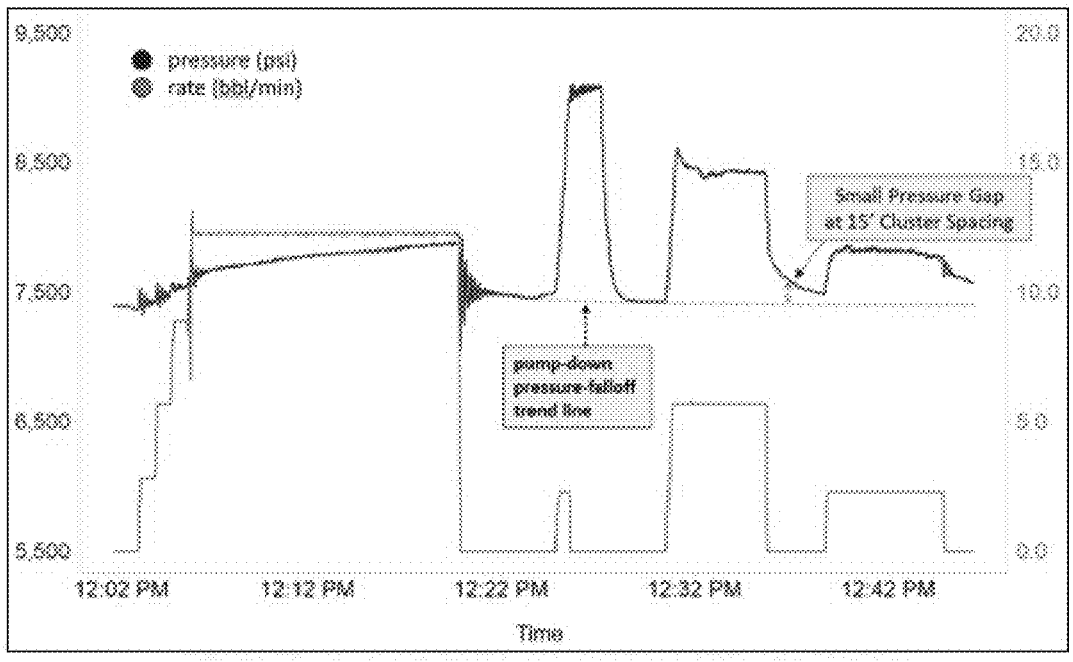
Figure 23. Example of typical pressure behavior during pump-down diagnostics on a fracturing stage at 15 ft (4.6 m) cluster spacing
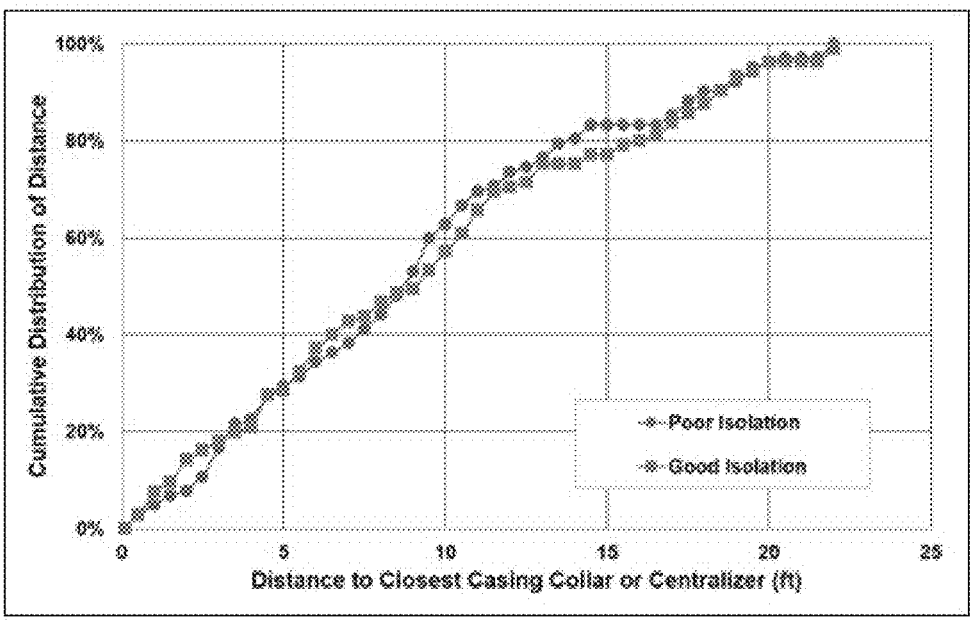
Figure 24. Cumulative distributions of distance between the 1st perforation cluster (toe side) and closest casing collar or centralizer location.

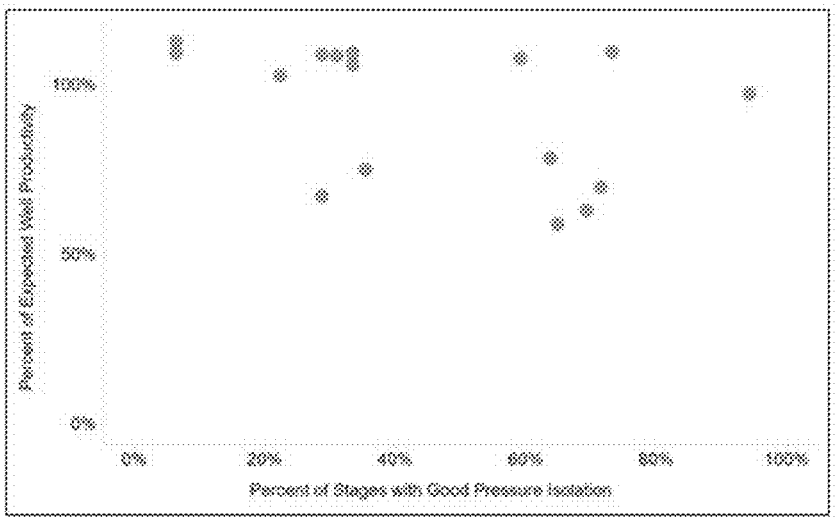
Figure 25. Scatter plot showing a comparison of well productivity against percent of stages with good pressure isolation. Each point is a well that was completed using 15 ft (4.5 m) cluster spacing.

HYDRAULIC INTEGRITY ANALYSIS

CROSS-REFERENCE TO RELATED APPLICATIONS

This application is a continuation application which claims benefit under 35 USC § 120 to U.S. application Ser. No. 17/577,848 filed Jan. 18, 2022, entitled "Hydraulic Integrity Analysis," which is a non-provisional application which claims benefit under 35 USC § 119(c) to U.S. Provisional Application Ser. No. 63/138,138 filed Jan. 15, 2021, entitled "Hydraulic Integrity Analysis," which is incorporated herein in its entirety.

STATEMENT REGARDING FEDERALLY SPONSORED RESEARCH

None.

FIELD OF THE INVENTION

The present invention relates generally to pump-down diagnostic testing, a technique for assessing near wellbore conditions and treatment isolation characteristics. It is more limited in scope than some of the previously discussed methods but requires no additional equipment or personnel to implement, is very economical and can be implemented on a large scale.

BACKGROUND OF THE INVENTION

In recent years, plug-and-perf has become a widely adopted hydraulic fracturing technique in horizontal wells completed in unconventional reservoirs (Weijers et al. 2019). It consists of using a wireline cable to run in the well with a frac plug for temporarily sealing previously treated intervals and multiple select-fire perforating guns for creating multiple new fracture-initiation intervals known as perforation clusters. The frac plug and perforating guns are moved down the lateral part of the well by pumping water at a sufficient rate to create drag force as the wellbore fluid flows past the guns, frac plug setting tool, and frac plug as it is being displaced into previously treated clusters. Once pumped to the desired location in the lateral and uphole from all preexisting perforations, pumping is stopped, the frac plug is set, new perforation clusters are created, and the wireline with spent perforating guns and frac plug setting tool is retrieved (see FIG. 1). A ball check is preinserted or pumped down the well to seal off the bore in the center of the frac plug during the subsequent fracturing treatment. Then the fracturing treatment is pumped through the newly created perforations. This process can be repeated many times, with each occurrence termed a fracturing stage. After the plug-and-perf fracturing project is complete, the frac plugs and ball checks dissolve or are milled and residue including proppant is circulated or flowed from the wellbore to the surface during a cleanout operation, which may utilize coiled tubing or jointed tubing. Upon the completion of the post-treatment wellbore cleanout, production can be achieved from all treated intervals. Plug-and-perf enables economic creation of an abundance of hydraulic fractures with substantial surface area, connecting a substantial portion of the reservoir rock to the wellbore.

While fracturing design has evolved significantly, featuring larger fluid and proppant volumes, reduced frac-stage interval length and tighter perforation cluster spacing, there are still concerns about each perforation cluster receiving a reasonably proportionate amount of fluid and proppant (Ugueto et al. 2016; Cramer et al. 2020). If slurry volume is unevenly distributed among the perforation clusters, the treatment is considered to have low perforation cluster efficiency.

Treatments have been designed with varying perforation cluster spacing for dealing with rock heterogeneity, so that rocks that are similar in mechanical behavior are treated simultaneously (Walker et al. 2012). However, this tactic does not address local stress variations resulting from rock displacements generated by previously created or actively propagating multiple fractures, known as stress shadowing (Sneddon 1946). To deal with the inevitable but hard-to-predict variations in rock stress, the limited entry method has been widely applied to achieve high backpressure in casing through choked flow to ensure fluid and proppant entry into most or all perforation clusters, which preferably connect to separate large-scale hydraulic fractures (Cramer et al. 2020).

Effective limited entry treatments require isolation within and outside of the casing (i.e., behind pipe), with intact solid cement filling the drilled hole/casing annular void between perforation clusters. For well-cement-bonded cases, tortuous pathways initially exist from perforation clusters to primary transverse fractures due to narrow, longitudinal starter fractures that are perpendicular to intermediate principal stress and result from drilled-hole hoop stress (Wright et al. 1997). This mechanism has been observed in laboratory block tests, as demonstrated in FIG. 2 (Weijers et al. 1994). It has also been inferred from distributed-temperature-sensing observations in instrumented wells, in which the estimated breadth of the longitudinal starter fracture and associated transversely oriented hydraulic fractures extended significantly beyond the associated perforation cluster by up to 14 ft in both directions along the lateral (Ugueto et al. 2019). Treatment isolation among fracturing stages and perforation clusters can be compromised as perforation cluster spacing approaches the breadth of this hydraulic fracturing network.

To improve perforation cluster efficiency, various diagnostic methods have been applied to characterize the degree of treatment variation among the perforation clusters. These methods include fiber optic measurements, tracers, perforation imaging and treatment pressure analysis.

Distributed acoustic and temperature sensing fiber optic technology (DAS, DTS) has been applied in both in-well (active) and cross-well (passive) applications (Ugueto et al. 2016; Zhang et al. 2017). In-well application refers to the data acquisition and interpretation collected on an instrumented well during the stimulation of the same well. With cross-well measurements, data is measured at a passive instrumented well during the treatment of an adjacent well. Successful implementation of fiber optic sensing projects requires intensive project planning, field operation and data interpretation efforts. The cost of project execution is very high. Thus, its application is generally limited to appraisal wells in new geologic areas or for comparing multiple treatment or completion techniques.

Tracers are used to evaluate perforation cluster efficiency by enabling identification of radioactively tagged particles in treated intervals. These particles are pumped with proppant during a fracturing treatment. After a post-treatment wellbore clean out, a spectral gamma-ray logging tool is run to identify tracer distribution and by association proppant placement in the near-wellbore region (Leonard et al. 2015). Up to three separate radioactive isotopes can be alternately used to estimate the lateral treatment coverage originating from the various frac stages. However, the depth of radioactive logging investigation is only about 2 ft, limiting the ability to determine the presence and concentration of tracers in discreet fractures. This limitation also makes tracer logging prone to detecting near-wellbore deposits of proppant in channels or low spots not associated with fractures or tracer material from a different frac stage that migrated to the logged interval during post-treatment clean out operations.

Downhole video and acoustic based imaging enable investigating individual perforations after stimulation. Significant perforation entry hole erosion has been sometimes indicated from the downhole images, providing evidence of variable slurry distribution across perforations (Cramer et al. 2020; Robinson et al. 2020). However, downhole imaging is typically limited to a small set of wells since additional wellbore preparation efforts are required for a successful operation and the total project cost is significant.

In summary, the diagnostic methods discussed above can provide valuable information for evaluating and modifying plug-and-perf designs for potential improvement in treatment efficiency. However, due to complicated operational procedures and significant cost requirements, their application is usually limited to a few selected candidates for appraisal testing.

BRIEF SUMMARY OF THE DISCLOSURE

The present invention relates generally to a multi-component diagnostic process of evaluating pressure responses associated with customized pump-down and perforating operations in plug-and-perf fracturing treatments. Results from field applications can be instrumental in assessing frac plug and cement sheath integrity, the degree of isolation from previous frac stages and perforation-cluster spacing efficiency, and in improving injectivity in all perforation clusters within a frac stage.

The method is based on analyzing wellbore pressure responses occurring at key segments of the pump-down and perforating operation and correlating the results among multiple frac stages and wells in a field or play. A special requirement is that the frac plug ball-check is run in with the tool string and pumped to seat prior to performing perforating operations. Optionally, a solid bridge plug (of any material composition, including composite type) or poppet-type frac plug (featuring a pre-installed check device) can be used in lieu of a ball-check type frac plug. The key segments are: 1.) pumping-down the wireline, frac plug, perforating guns and accessories to the desired location in the wellbore, then briefly monitoring shut in pressure, 2.) pressure testing the wellbore after setting the frac plug with the ball-check on seat (or simply setting the alternative wellbore-plugging devices noted previously), 3.) selectively shooting perforations in the cluster closest to the toe of the well, and 4.) selectively injecting wellbore fluid into that perforation cluster. For the segments 3 and 4, the pressure response is compared to the pressure decline trend at the end of pump-down (segment 1), looking for characteristic responses associated with isolation from or communication to previous frac stages. A complementary benefit of this process is that selectively establishing injectivity in most distant perforation cluster facilitates spearhead or wireline acid coverage across all perforation intervals for uniform reduction in near-wellbore tortuosity.

In one embodiment, a hydrocarbon well is tested by running a wireline and bottomhole assembly (BHA) consisting of frac plug, setting tool, multiple perforating guns and casing collar locator, with the frac ball (ball check) preinstalled in the frac plug until said BHA reaches the build section of the well; pumping water into the well at a rate of 5-15 bbl/min (0.79-2.4 $m^3$/min) to drag the BHA to the desired location in the lateral; shutting down the pump to obtain an instantaneous shut in pressure (ISIP) and 3 to 5 minutes of shut-in pressure for establishing a pump-down pressure-falloff trend line; activating the setting tool to set the frac plug; moving wireline up the well to place the gun string at the first perforating location; pumping at 1-2 bbl/min (0.16-0.32 $m^3$/min) to seat the frac ball in the frac plug, wherein seating said frac ball isolates previously treated intervals and forms a closed wellbore chamber from the frac plug to surface treating lines; pressurizing the wellbore to at least 1000 psi (6.9 MPa) above the pump-down shut-in pressure; closing a plug valve in the surface treating line to isolate the pumping equipment and optional safety relief valve during this pressure test; monitoring pressure for 3 to 5 minutes to check for pressure-tightness of the closed wellbore chamber; maintaining pressure, selectively perforate the first (toc-ward) cluster interval only and observe pressure falloff response for 3 to 5 minutes; evaluating for communication with or isolation from the previously treated intervals; moving the wireline up the well to locate the BHA away from the perforations; reopen the plug valve; injecting into the first cluster at an injection rate of 2 bbl/min (0.32 $m^3$/min) until treating pressure stabilizes or breaks back; increasing the injection rate to 5-6 bbl/min (0.79-0.95 $m^3$/min), continuing to pump until pressure re-stabilizes; pumping for at least an additional minute; shutting down to obtain ISIP and evaluate pressure falloff response for 3-5 minutes; optionally evaluating for indication of communication with or isolation from the previously treated intervals; perforating the remaining clusters, re-establishing injection at 2 bbl/min (0.32 $m^3$/min) while perforating; discontinue injection after perforating is complete; and retrieving wireline, setting tool and spent guns and prepare the well for the next frac stage.

Optionally, inhibited HCl acid (wireline acid) can be injected during the pump down process and spotted at a sufficient distance uphole from the location of the most distant perforation cluster, to prevent placing the acid in a dead space downstream of that perforation cluster. Injection time is extended during the diagnostic injection test until the wireline acid enters the just-perforated distant perforation cluster. As a result, the wireline acid is placed across all perforation clusters to be subsequently perforated for the upcoming fracturing stage. After perforating all clusters, water is again injected to displace the wireline acid from the wellbore into the formation. This operation can be performed immediately, or at the start of the main fracturing treatment.

In a preferred embodiment, an optimized automated hydraulic integrity system may be used to adjust integrity analysis parameters in real-time.

As used herein, hydraulic fracturing or fracturing (abbreviated as "frac") is the propagation of fractures through layers of rock using pressurized fracturing fluid. This technique is primarily used in the extraction of resources from low permeability reservoirs, but may be used in a variety of reservoir types where stimulation is required.

As used herein, BHA or bottomhole assembly refers to a fracturing BHA which includes a frac plug, setting tool, perforating guns, CCL, and other downhole tools that may be used for a completion. A bottomhole assembly may also include gauges, sensors, pumps, switches, valves, and other tools that facilitate completion of the well bore.

As used herein, distributed acoustic sensing or DAS is the measure of Rayleigh scatter distributed along the fiber optic cable. A coherent laser pulse is sent along the optic fiber, and scattering sites within the fiber cause the fiber to act as a distributed interferometer with a gauge length approximately equal to the pulse length. The intensity of the reflected light is measured as a function of time after transmission of the laser pulse. When the pulse has had time to travel the full length of the fiber and back, the next laser pulse can be sent along the fiber. Changes in the reflected intensity of successive pulses from the same region of fiber are caused by changes in the optical path length of that section of fiber. This type of system is very sensitive to both strain and temperature variations of the fiber and measurements can be made almost simultaneously at all sections of the fiber.

As used herein, low frequency DAS or LF-DAS refers to a frequency component of the DAS signal that has a period of about 1 second or greater for an interferometer length of a few meters. By using the phase of the low frequency components of the DAS signal, changes along the fiber can be estimated and monitored in real time and with much higher precision than is possible with a conventional measurements. The processor may be configured to process DAS signal data to separate out the low frequency oscillations present in DAS signals.

As used herein, distributed temperature sensing or DTS is a way of measuring temperature in a continuous manner. DTS systems are optoelectronic devices that measure temperature by means of optical fibers functioning as linear sensors. Temperatures are recorded along the optical sensor cable, thus not at discrete widely separated points, but as a continuous profile. Temperature determination is achieved over great distances. Typically the DTS systems can locate the temperature to a spatial resolution of 1 m with accuracy to within ±1° C. at a resolution of 0.01° C. Measurement distances of greater than 30 km can be monitored and some specialized systems can provide even tighter spatial resolutions.

As used herein, diagnostic fracture injection test or DFIT, comprises injecting a relatively small volume of fluid into the subsurface and creating a hydraulic fracture. After the end of injection, the pressure in the wellbore is monitored. The pressure measurements are used to infer properties of the formation, including the leak-off coefficient, permeability, fracture closure pressure (which is related to the magnitude of the minimum principal stress and the net pressure), formation pressure, and the like. These parameters are utilized for hydraulic fracture design and reservoir engineering.

As used herein, instantaneous shut-in pressure ISIP is in adjacent wells, in the same well, or at a surface pressure gauge.

BRIEF DESCRIPTION OF DRAWINGS

FIG. 1 demonstrates the plug-and-perf method of stimulating multiple intervals in a horizontal well.

FIG. 2 shows a longitudinal starter fracture, which increases the breadth of fracturing along the lateral.

FIG. 3 shows a rate/pressure plot of a pump-down diagnostics operation.

FIG. 4 shows the a.) frac ball (ball check) being preinstalled in the frac plug and b.) bottomhole assembly.

FIG. 5 demonstrates a typical DFIT pressure profile via toe initiation valve in a cemented horizontal well.

FIG. 6 is an example of isolation from previously treated intervals.

FIG. 7 is an example of water hammer oscillations following perforating.

FIG. 8 is an example of water hammer oscillations during the shut-in period following the pump-down event.

FIG. 9 is an example of communication to previously treated intervals.

FIG. 10 is an example of sustained ball seat failure following the perforating event.

FIG. 11 is another example of sustained ball seat failure following the perforating event.

FIG. 12 demonstrates failure of frac plug during the injectivity test.

FIG. 13 shows a leak detected during the system pressure test.

FIG. 14 is an example of frac plug failure and wireline tension increase during injectivity test.

FIG. 15 tracks the incremental time to perform pump-down diagnostics.

FIG. 16 shows separation from the pump-down pressure-falloff line for a Baltic Basin case study.

FIG. 17 provides rate and treating pressure behavior during injectivity tests for a Baltic Basin case study.

FIG. 18 shows cement coverage as measured by Radial Bond Tool, in lateral section covered by fracturing stages 4-5.

FIG. 19 is a summary of pump-down diagnostics results on 27 wells.

FIG. 20 shows pressure isolation between stages as a function of cluster spacing distance.

FIG. 21 is an example of typical pressure behavior during pump-down diagnostics on a fracturing stage at 35 ft (10.7 m) cluster spacing.

FIG. 22 is an example of typical pressure behavior during pump-down diagnostics on a fracturing stage at 25 ft (7.6 m) cluster spacing.

FIG. 23 is an example of typical pressure behavior during pump-down diagnostics on a fracturing stage at 15 ft (4.6 m) cluster spacing.

FIG. 24 compares cumulative distributions of distance between the 1st perforation cluster (toe side) and closest casing collar or centralizer location for cases of good and poor isolation.

FIG. 25 is a scatter plot showing a comparison of well productivity against percent of fracturing stages with good pressure isolation. Each point represents a well that was completed using 15 ft (4.5 m) cluster spacing.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The general procedure for a pump-down diagnostic test is outlined below and depicted in the rate-pressure treatment chart shown in FIG. 3:

1. Run in the well with wireline and bottomhole assembly (BHA) consisting of frac plug, setting tool, multiple perforating guns and casing collar locator, with the frac ball (ball check) preinstalled in the frac plug (FIGS. 4*a* and 4*b*). Optionally, a solid bridge plug (of any material composition, including composite type) or poppet-type frac plug (featuring a pre-installed check device) can be used in lieu of a ball-check type frac plug.

2. When wireline reaches the build section of the well, initiate pumping water into the well at a rate of 5-15 bbl/min (0.79-2.4 $m^3$/min) to drag the BHA to the desired location in the lateral (i.e., pump-down process). During the pump-down, wellbore fluid is entering previously treated perforation clusters.
3. Shut down to obtain an instantaneous shut-in pressure (ISIP) and 3 to 5 minutes of shut-in pressure for establishing a pump-down pressure-falloff trend line.
4. Following this brief shut-in period, activate the setting tool to set the frac plug. Then move wireline up the well to place the gun string at the first perforating location, which is the perforation cluster closest to the toe of the well.
5. Pump at 1-2 bbl/min (0.16-0.32 $m^3$/min) to seat the frac ball (ball check) in the frac plug, isolating the previously treated intervals and forming a closed wellbore chamber from the frac plug to surface treating lines (or simply set one of the alternative wellbore-plugging devices noted previously).
6. Pressure the wellbore to at least 1000 psi (6.9 MPa) above the pump-down shut-in pressure. Then close a plug valve in the surface treating line to isolate the pumping equipment and safety relief valve (if applicable) during this pressure test. This will prevent potential bleed-back of fluid at the surface to enable selective evaluation of frac plug pressure integrity. Also monitor the wireline lubricator seal throughout the process to check for indications of fluid bleed-back and make adjustments if necessary to achieve a leak-tight seal.
7. Monitor pressure for 3 to 5 minutes to check for pressure-tightness of the closed wellbore chamber.
8. Maintaining pressure, selectively perforate the first (toe-ward) cluster interval only and observe pressure falloff response for 3 to 5 minutes, evaluating for communication with or isolation from the previously treated intervals. Then move wireline up the well to locate the BHA away from the perforations.
9. Reopen the plug valve. Inject into the first cluster at an injection rate of 2 bbl/min (0.32 $m^3$/min) until treating pressure stabilizes or breaks back. Then increase the injection rate to 5-6 bbl/min (0.79-0.95 $m^3$/min), continuing to pump until pressure re-stabilizes. Pump for at least an additional minute. Note: when using inhibited HCl acid (wireline acid) in conjunction with the pump-down process, extend the fluid injection until the wireline acid arrives at the open perforation cluster, then discontinue injection. Doing this will result in the acid being spotted across all subsequent perforation cluster locations, for more uniform reduction of near-wellbore tortuosity among the newly perforated clusters during acid displacement.
10. Shut down to obtain ISIP and evaluate pressure falloff response for 3-5 minutes, once again evaluating for indication of communication with or isolation from the previously treated intervals.
11. Perforate the remaining clusters, re-establishing injection at 2 bbl/min (0.32 $m^3$/min) while perforating. Note: if wireline acid was spotted across perforations, it can optionally be displaced from the wellbore after perforating all clusters-if casing corrosion is a concern. Injection rate can be increased at this time.
12. Discontinue injection after perforating (and acid displacement if implemented) is complete; retrieve wireline, setting tool and spent guns and prepare the well for the next fracturing stage.

During the pump-down diagnostic process, surface pressure, injection rate and wireline data should be recorded to file at a fixed increment of 1 second. Pressure gauge resolution of 0.1 psi (689 Pa) or better is required.

The primary objectives of performing pump-down diagnostics are to evaluate the sealing characteristics of the frac plug, the capacity of the cement sheath to provide isolation from the previously treated intervals in the wellbore, and the impact of cluster spacing on treatment isolation. Secondary objectives include: ability to spot inhibited HCl acid (wireline acid) across the entire perforated interval, evaluation the components of pressure drop in the wellbore system including friction across the bottomhole assembly (BHA) during the pump-down operation for identification of restrictions in the wellbore, comparing pump-down ISIP, leak-off characteristics and water hammer responses among frac stages for assessing in-situ stress and near-wellbore fracture conductivity and locating areas of reservoir pressure depletion and enhanced permeability. For a variation of the last secondary objective, see Roark et al 2017.

The following examples of certain embodiments of the invention are given. Each example is provided by way of explanation of the invention, one of many embodiments of the invention, and the following examples should not be read to limit, or define, the scope of the invention.

Example 1: Diagnostic Signatures

Diagnostic fracture injection tests (DFIT's) conducted from a single initiation site near the toe of cased/cemented horizontal wells are characterized by an elevated instantaneous shut-in pressure (ISIP) followed by steep pressure falloff after shut-in. An example of a horizontal-well DFIT is exhibited in FIG. 5. The unstable pressure behavior indicates the existence of a tortuous, narrow flow path (longitudinal starter fracture) connecting the wellbore to a primary transverse fracture (Cramer and Nguyen 2013, McClure et al 2019). In this case, the friction pressure due to near-wellbore tortuosity=7615 psi (52.5 MPa) [unadjusted ISIP]−6742 psi (46.5 MPa) [adjusted ISIP]=873 psi (6.1 MPa). This DFIT exemplifies a cement-bonded interval in isolation from previously treated intervals (it is the only open interval in the well). It serves as a guidepost for pressure behavior attributable to interval isolation from previously treated intervals during pump-down diagnostic perforating and injectivity testing events.

The rate-pressure record of a pump-down diagnostic sequence conducted after the second fracturing stage on a well in the Baltic Basin is shown in FIG. 6. Perforation clusters in the well were uniformly spaced at 32.8 ft (10 m) intervals. A pump-down pressure-falloff trend line (green dashed line) was constructed for comparison to pressure responses of the closed-chamber perforating event and subsequent injectivity test. Pressure dropped modestly upon perforating, maintaining a level at least 600 psi (4.1 MPa) above the pump-down trend line.

The increase in surface pressure during the post-perforating shut-in period is the result of fluid expansion due to thermal recovery from wellbore cooling. The cooling resulted from the large volume of water injected during previous treatment stages. The pressure buildup indicates that closed-chamber conditions prevailed due to excellent wellbore tubular integrity and effective scaling from previously treated intervals by the frac plug. It also indicates that minimal if any fluid is leaving the wellbore due to lack of behind-pipe communication to previous intervals and the extremely low permeability of the contacted reservoir rock.

An oscillatory pressure signature (known as a water hammer) was observed upon perforating. It was generated by the gun detonation shockwave in a wellbore system lacking the ability to discharge fluid through the new perforations. This led to a strong change in momentum of the detonation pulse which favored the formation of the water hammer (Nguyen et al. 2021). A distinguishing characteristic is that the frequency of water hammer oscillations in this closed-chamber environment (see FIG. 7) was twice the frequency of water hammer oscillations produced following the end of the pump-down (see FIG. 8), since wellbore fluid during the pump-down injection was injected into a large hydraulic fracture system of constant-pressure conditions that was created during the previous treatment (Holzhausen and Gooch 1985). The oscillation decay rate was lower for the perforating event since friction is less when the travel path of the water hammer pulse is limited to the closed chamber wellbore.

A rate of 6 bbl/min (0.95 $m^3$/min) was achieved during the injectivity test, with a tortuous near-wellbore flow restriction indicated by the very high surface treating pressure. When this characteristic is combined with the high, unstable ISIP and significant separation of shut-in pressure from the pump-down pressure-falloff trend line [~1700 psi (~11.7 MPa)], the injectivity test pressure response resembles a toe DFIT, providing strong indication that the new treatment interval is completely isolated from the previously treated intervals and that cement sheath quality is adequate in this part of the lateral.

The rate-pressure record of a pump-down diagnostic testing sequence conducted after the tenth fracturing stage on the same Baltic Basin well is shown in FIG. 9. A pump-down pressure-falloff trend line (green dashed line) was constructed for comparison to pressure responses corresponding to the closed-chamber perforating event and subsequent injectivity test. Pressure dropped rapidly upon perforating, to the same level and trend as the pump-down trend line, indicating the newly perforated interval was in communication with the previously treated intervals. A rate of 6 bbl/min (0.95 $m^3$/min) was achieved during the injectivity test, with a high surface treating pressure indicating a tortuous flow restriction, but at a much lower magnitude than the previous example, i.e., 6800 psi (46.9 MPa) vs 8800 psi (60.7 MPa). The ISIP was high and unstable, again indicating an annular flow restriction. But pressure rapidly dropped to the same level and trend as the pumpdown trend line during shut in, confirming the diagnosis of communication with the previously treated interval(s) and suggesting that cement sheath quality is inadequate in this part of the lateral.

The rate-pressure record of a pump-down diagnostic testing sequence done in a well in south Texas is shown in FIG. 10. The single perforation cluster consisted of three 0.40 in diameter entry holes. Communication to previously treated intervals is indicated by rapid decreases in pressure to the pump-down pressure-falloff trend line following both the perforating event and injectivity test. But the observations that follow led to the conclusion that the main communication pathway was through the frac plug opening due to problems with the frac ball staying on the frac plug seat.

An abnormally high injection rate [over 8 bbl/min (1.3 $m^3$/min)] was required to seat the ball for performing the pre-perforating closed chamber pressure test, indicating a defect in the ball or its seat. Surface treating pressure was very low throughout the injectivity test with total friction pressure of 210 psi (1.4 MPa), well less than the predicted friction pressure for injecting through three 0.40 in (10.2 mm) entry holes [495 psi (3.41 MPa)] but slightly greater than the predicted friction for injecting through an 1 in. (25.4 mm) opening in the frac plug [100 psi (0.69 MPa)].

Water hammer events were exhibited when pumping was ended following the injectivity test and the injection during perforating the remaining clusters. In this case, the water hammer oscillations appeared to be of the same frequency as the water hammer oscillations following the pump-down, another indication of strong connection to the hydraulic fracture system associated with previously treated intervals. Water hammer events associated with large conductive hydraulic fracture systems are indicative of through-pipe communication, since behind-pipe channels usually have some degree of flow-path restriction or tortuosity. Tortuosity results in the buildup of back pressure in the casing during injection, leading to restricted, slowly declining flow through the perforations after surface shut in, which suppresses water hammer development.

The rate-pressure record of a pump-down diagnostic testing sequence conducted in an offsetting well in south Texas is shown in FIG. 11. The pressure signatures were very similar to the previous case with the exception that the frac ball was easily seated using the normal injection rate [2 bbl/min (0.32 $m^3$/min)] and a pressure buildup trend developed during the pressure test, indicating that closed-chamber conditions prevailed due to excellent tubular and wellhead integrity and effective sealing from previously treated intervals by the frac plug.

The rapid drop in pressure to the pump-down pressure-falloff trend line following the perforating event coupled with a water hammer oscillatory pulse indicated the frac ball instantly fell off seat or broke apart upon perforating. This enabled the decompressing wellbore fluid to surge through the unplugged opening in the frac plug, inducing a brief but strong rate pulse into a previously treated interval and causing a water hammer after the rate pulse terminated.

Subsequent activities exhibited an identical pattern to the previous test with no evidence that the frac ball reseated. Surface treating pressure was very low throughout the injectivity test with total friction pressure of 210 psi (1.4 MPa), well less than the predicted friction pressure for injecting through three 0.40 in (10.2 mm) perforations [605 psi (4.2 MPa)] but slightly greater than the predicted friction for injecting through an 1 in. (25.4 mm) opening in the frac plug [123 psi (0.85 MPa)].

The rate-pressure record of a pump-down diagnostic testing sequence conducted on a different treatment stage on the same well as above is shown in FIG. 12. Surface pressure during the post-perforating shut in period remained well above the pump-down pressure-falloff trend line, indicating isolation from previously treated intervals. During the early part of the injection test, pressure climbed sharply indicating sustained isolation but it dropped sharply as 9400 psi (64.8 MPa) was exceeded, resulting in a strong water hammer with the same implications as noted in the previous example but with one exception. In this case, the total friction pressure at the end of the injectivity test was 84 psi (0.57 MPa), less than the predicted friction for injecting through a 1 in. (25.4 mm) opening in the frac plug [100 psi (0.69 MPa)]. The reduced friction relative to the other cases combined with the sharp pressure break is indicative of destruction of the frac plug or mobilization of it past previously treated intervals.

Cases of direct communication through the wellbore due to an unseated frac ball or failed frac plug have been infrequently observed in pump-down diagnostics testing. These examples are included to show potential situations that could be encountered which could give misleading results in terms of measuring cement containment between stages.

The pressure test and perforating portion of pump-down diagnostics testing on another horizontal well in south Texas is shown in FIG. 13. Although the testing indicated isolation of the newly perforated interval from the previous frac stage, pressure declined throughout the pressure test indicating a leak in the system. A similar leak was indicated for the eight stages in the well that were evaluated with this process even though isolation from the previously treated intervals was indicated in all tests. Although the leak source may have the frac plug, the possibility exists that the pressure loss resulted from an upstream leak, in the casing string or more likely at the surface through pumping equipment or wireline lubricator. To achieve the proper diagnosis, it is important to eliminate surface bleed back and conduct a properly executed and documented pressure test of the casing and wellhead prior to pump-down activities.

Due to pre-installation of the frac ball in the frac plug, a complete perforation gun misfire following setting of the frac plug will result in a job delay, since the ability to do another pump-down is lost once frac plug is set. In those cases, an additional perforating gun run must be made to complete the perforating process by using a wireline tractor or coiled tubing. Using a perforating system featuring addressable-switch gun firing significantly reduces the chance of total misfire, since a gun that fails to detonate can be bypassed and the next gun in sequence can be fired. When using perforating systems with a diode-switch firing mechanism, any misfire in the gun sequence prevents firing of additional guns and forces premature retrieval of the BHA.

Another potential risk is failure to achieve injectivity into any perforation cluster without spotting HCl acid. This would require a coiled tubing run to spot and inject acid into the perforations. This is a very rare occurrence when tubulars and wellhead with high pressure ratings are used. To access this risk, prior treatments in the region should be researched to assess the potential for injectivity problems.

An infrequent problem with pump-down diagnostic injectivity testing was experienced in an early application and exhibited in FIG. 14. The sudden failure and mobilization of the frac plug down the lateral during the pump-down injectivity test exposed previously treated intervals, resulting in a pressure decline of 3637 psi (25.1 MPa) within a 2-second period. The calculated fluid expansion in the wellbore due to the sudden pressure loss was 2.77 bbl (0.44 $m^3$) [i.e., 83 bbl/min (13.2 $m^3$/min)]. When the fluid-expansion pulse was added to the surface injection rate of 10 bbl/min (1.6 $m^3$/min), the downhole flow rate was calculated to be 93 bbl/min (14.8 $m^3$/min) during that 2-second interval. The wireline tension increased from 1499 lbf (680 kg) to 4481 lbf (2033 kg) because of the flow surge. The increased wireline tension led to the BHA parting from the wireline at the weak point, necessitating a remedial effort to recover the perforating guns. A failed pressure test was a prelude to this event, indicating a pre-existing problem with the frac plug. In subsequent applications, reductions in injection rate and pressure differential across the frac plug were invoked upon a failed pump-down diagnostic pressure test or the injectivity test was bypassed altogether.

Time is money. The primary cost of performing pump-down diagnostics is the incremental time required to perform the work. Incremental time is calculated by determining the elapsed time between the start of the frac plug pressure test and the end of the injectivity pressure-falloff period. The incremental time required for a pump-down diagnostics project performed in south Texas is shown in FIG. 15. The statistical calculations on the incremental time follow—mean=12 minutes, 51 seconds; median=13 minutes, 51 seconds; standard deviation=57 seconds. When performed on a multi-well zipper fracturing project with a dedicated pump-down crew, there is often no additional time required to perform pump-down diagnostics since pump-down operations on one well can be performed while stimulating the offset well.

Example 2: Case Study-Baltic Basin

This case study is based on a horizontal well completed in the Ordovician Sasino formation in the Baltic Basin of northcentral Poland. The well was drilled to a true vertical depth of 9269 ft (2825.2 m) and had 4910 ft (1497 m) of lateral coverage within the Sasino interval. The casing long-string cement job design specified mixing and pumping 50 bbls (7.9 $m^3$) of 15.0 lb/gal (1.80 kg/L) weighted spacer and 425 bbls (67.6 $m^3$) of 16.0 lb/gal (1.92 kg/L) Class G cement, to be displaced with 3 bbls (0.5 $m^3$) of weighted spacer and 343 bbls (54.5 $m^3$) of 2% KCl water at a rate of 6 bbl/min (0.95 $m^3$/min). Fluids and cement slurry were mixed and pumped as per plan. However, the top cementing plug failed to launch during job execution, leading to severe channeling within the lateral part of the wellbore as the lighter, lower viscosity displacement fluid fingered through and migrated above the denser, more viscous spacer and cement. This channeling phenomenon was evidenced by a leaking shoe joint and layer of set cement in the bottom part of the lateral which necessitated extensive cleanout work prior to doing the fracturing treatments. The plug-and perf treatment process was combined with limited entry treatment methods in performing 25 frac stages with 6 perforation clusters per frac stage. Clusters were spaced at 32.8 ft (10 m) intervals, which was well beyond the expected breath of the longitudinal starter fracture and associated transverse fractures. Pump-down diagnostics were performed during all 24 pump-downs. Rate/pressure plots for two of these pump-down diagnostic tests were previously shown in FIGS. 6 and 9. Pressure integrity tests and general pressure behavior during the diagnostic sequences indicated that the frac plug effectively isolated the wellbore from previously treated intervals in all cases. Yet as indicated in FIG. 16, there were numerous instances of rapid pressure decline to the pump-down pressure-falloff trend line following perforating and injectivity testing (i.e., zero pressure difference, indicated by a null value in the bar chart) in the toe-ward half of the well (stages 1-12). This behavior is indicative of annular communication to the previously treated intervals. It is attributable to inadequate cement sheath quality given the relatively wide spacing between perforation clusters (outside the breath of the longitudinal fracture component) and corroborates the diagnosis of channeling by the displacement water. Very good isolation from the previously treated intervals was exhibited in the 10 of 12 stages in the up-hole portion of the lateral, as evidenced by substantial positive pressure difference when compared to the pump-down pressure-falloff trend line following perforating and injectivity testing. This finding indicated that the channeling phenomenon was limited to the trailing part of the cement slurry.

Treating pressure tended to be much higher during the injection tests in fracturing stages demonstrating behind-pipe isolation from the previous treated intervals. This relationship is exhibited in FIG. 17. These injections had characteristics resembling the completely isolated toe-sleeve DFIT shown in FIG. 5. The average injection rate and maximum surface treating pressure for frac stages exhibiting isolation were 4.0 bbl/min (0.64 $m^3$/min) and 8133 psi (56.1 MPa), respectively. The average injection rate and maximum surface treating pressure for frac stages exhibiting communication to the previous frac stage were 5.3 bbl/min (0.79 $m^3$/min) and 6549 psi (45.2 MPa), respectively.

Incremental time for doing the diagnostic testing was calculated by determining the elapsed time between the beginning of the frac plug pressure test and the end of the injectivity pressure-falloff period. Here are the statistical calculations on incremental time for the 24 stages: mean=19 minutes; median=16 minutes; mode=16 minutes; minimum=13 minutes; maximum=34 minutes.

Cement quality in the annular gap between casing and drilled hole was evaluated prior to the fracturing treatments with an acoustic radial bond tool. Log results for a lateral section near the toe of the well, from 4200-4260 m (13,780-13,976 ft) measured depth are shown in FIG. 18. Although the log interpretation indicated excellent cement sheath quality, pump-down diagnostic testing indicated strong communication to the previous treated interval within this same interval, which is reasonable given the evidence of severe channeling of cement with displacement fluid. At least in this case, pump-down diagnostics provided a more accurate means of assessing cement sheath quality than the cement evaluation tool.

Example 3: Case Study-South Texas

Using the method listed in previous sections of the paper, pump-down diagnostics were performed on 27 horizontal wells drilled in a south Texas reservoir. Interpretable data was collected on a total of 304 stages for determining if there was pressure isolation from the previous stage.

Analysis of pressure responses. A summary of the testing outcomes for all wells is shown in FIG. 19. Results were widely variable, as positive indication of pressure isolation ranged from 0-100% of the evaluated stages per well. This chart also indicated that for many stages, pressure isolation was indeterminant (i.e., stage outcomes indicated as maybe) as pressure was only slightly delayed in declining to the pump-down trend line yet elevated surface pressure was observed during injectivity testing which indicated significant near-wellbore tortuosity. This behavior implied limited communication to the previously treated intervals and that a cement sheath was present and offering some resistance to behind-pipe flow.

The variable that had the strongest correlation with indicated pressure isolation between stages was cluster spacing. Stages that implemented wider cluster spacing had a higher likelihood of exhibiting good pressure isolation between stages. This relationship is illustrated in FIG. 20. For the wells in this study, cluster spacing was considered to be equal to the distance between the perforation closest to the heel of the well of the prior stage and the perforation closest to the toe of the well of the tested stage.

It is notable that abundant data was available for cases with 15 ft (4.6 m) cluster spacing (256 stages), less data was available for cases with 25 ft (7.6 m) cluster spacing (43 stages), and even less data was available for cases with 35 ft (10.7 m) cluster spacing (5 stages). However, stages with wider cluster spacing regularly had much larger surface pressure separations from the pump-down pressure-falloff trend line following the injectivity test, which supports the notion of cluster spacing being a dominant factor in pressure isolation between stages. The examples shown in FIGS. 21 through 23 are from the study area and represent pressure behavior for various cluster spacings.

To further evaluate the impact of cement quality on isolation characteristics, treatment isolation was correlated with the distance between the tested perforation cluster and the closest casing collar or centralizer. In a horizontal wellbore, the casing string tends to lay on the low side of the wellbore. A casing centralizer or casing collar with its larger OD forms an external upset that helps support the string and increases clearance on the low side, improving cement quality along the corresponding lateral interval (Haut and Crook 1979). Treatment isolation as a function of the distance between tested perforation clusters and the closest casing collar or centralizer is shown in FIG. 24. The pump-down diagnostic test results are categorized into good isolation and poor isolation groups. The calculated distance for both groups exhibits a similar trend on the cumulative distribution plot. This indicates mechanisms other than cement quality may be affecting treatment isolation among perforation clusters or intervals. A likely influencing mechanism is the breadth of the longitudinal starter fractures as noted in the Introduction section and depicted in FIG. 2. At some point, cluster spacing is going to fall within the range of hydraulic fracturing activity dictated by the longitudinal fracturing component, greatly increasing the frequency of communication between fracturing stages.

Well production analysis. Of the wells completed with 15 ft (4.6 m) cluster spacing, 16 wells have been on production for a minimum of 9 months and were compared against expected productivity, i.e., mass production rate divided by calculated reservoir pressure drawdown. The findings are shown in FIG. 25, indicating there is no correlation between well productivity and the degree of inter-stage pressure isolation as determined from pump-down diagnostics testing. The metric for expected well productivity was based on historical productivity of nearby wells with similar completion designs in the same geological area and was normalized for the lateral length. The underperformance of wells that are below 80% of expected productivity is believed to be caused by depletion from nearby parent wells. An extended zone of fracturing along the lateral for individual perforation clusters could result from the presence of pre-existing fractures and is a possible explanation for higher performing wells that show poor inter-stage isolation.

Despite these findings, when treatments are confined to targeted perforations and even better, targeted perforation clusters, the created far-field transverse fractures along the lateral will be more uniform in extent and distribution. Reservoir simulations indicate that hydraulic fracture uniformity leads to more uniform drainage of reservoir rock and superior long-term field economics. Short-term production results do not always capture the negative effects of irregular fracture coverage, especially when observations are limited to a small set of wells. For the South Texas case study wells, 15 ft cluster spacing may be too close to prevent inter-stage communication during the subsequent high-volume fracturing treatments, even when a high-quality cement sheath is present. Determining volume-dependent inter-stage communication tendencies is not within the scope of pump-down diagnostics testing.

Example 4: Automated Hydraulic Integrity Analysis

By developing a model of previous integrity analyses along with real-time data, an automated hydraulic integrity system can be deployed to 1.) generate a pump-down trend line and compute the amount of separation between that trend line and post-perforation and injectivity-test pressure responses and 2.) calculate the periodicity and decay rate of water hammer oscillations. This information is then processed using an algorithm routine to determine the existence or absence of inside-pipe and behind-pipe isolation of the new treatment stage from previously treated intervals. This same automated system can process databased operational data to dramatically reduce the time required to analyze historical pump-down data.

Pump-down diagnostics provide a means of checking if communication is occurring between a just-perforated fracturing stage and previously treated intervals, which can serve as a key performance indicator for treatment control and cement sheath integrity. For moderate perforation cluster spacing (e.g., 33 ft (10 m) between clusters), pump-down diagnostics have been shown to provide a more reliable diagnosis of cement sheath quality along the lateral than cement bond log evaluation. For close perforation cluster spacing (e.g., 15 ft (4.6 m) between clusters), pump-down diagnostic results for stage isolation may be more affected by the breadth of the longitudinal starter fracture and associated hydraulic fracturing activity than by the cement sheath quality. The timing and oscillatory frequency of water hammer events observed during pump-down diagnostic operations offer additional clues to the nature of inter-stage communication. Pump-down diagnostics are time efficient and economical, typically requiring about 15 minutes per frac stage. Pump-down diagnostics risk factors can be effectively mitigated by using an addressable-switch select-fire perforating system, applying area experience to assess fracture initiation behavior in the absence of spotting HCl, and modifying or foregoing the injectivity test if the frac plug fails the pressure test.

In closing, it should be noted that the discussion of any reference is not an admission that it is prior art to the present invention, especially any reference that may have a publication date after the priority date of this application. At the same time, each and every claim below is hereby incorporated into this detailed description or specification as a additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application. Incorporated references are listed again here for convenience:

1. Cramer, D., Frichauf, K., Roberts, G., Whittaker, J. 2020. Integrating Distributed Acoustic Sensing, Treatment-Pressure Analysis, and Video-Based Perforation Imaging to Evaluate Limited-Entry-Treatment Effectiveness. SPE Production & Operations 35 (04): 0730-0755. November. SPE 194334-PA. dx.doi.org/10.2118/194334-PA
2. Cramer, D., Nguyen, D. 2013. Diagnostic Fracture Injection Testing Tactics in Unconventional Reservoirs. SPE Hydraulic Fracturing Technology Conference, The Woodlands, TX, 4-6 February. SPE 194371-MS. dx.doi.org/10.2118/163863-MS
3. Ghidaoui, M., Zhao, M., McInnis, D., et al. 2005. A Review of Water Hammer Theory and Practice. Applied Mechanics Reviews. January. Vol. 58: 49-76.
4. Haut, R., Crook, R. 1979. Primary Cementing: The Mud Displacement Process. 54th Annual SPE Fall Technical Conference and Exhibition, Las Vegas, NV, 23-26 September. SPE 8253. dx.doi.org/10.2118/8253-MS
5. Holzhausen, G., Gooch, R. 1985. Impedance of Hydraulic Fractures: Its Measurement and Use for Estimating Fracture Closure Pressure and Dimensions. SPE/DOE Low Permeability Gas Reservoirs Symposium, Denver, CO, 19-22 May. SPE/DOE 13892. http://dx.doi.org/10.2118/13892-MS
6. Leonard, R . . . , Moore, C . . . , Woodroof, R., et al. 2015. Refracs-Diagnostics Provide a Second Chance to Get it Right. SPE Annual Technical Conference and Exhibition, Houston, TX, 28-3-September. SPE-174979-MS. dx.doi.org/10.2118/174979-MS
7. McClure, M., Bammidi, V., Cipolla, C., Cramer, D., et al. 2019. A Collaborative Study on DFIT Interpretation: Integrating Modeling, Field Data, and Analytical Techniques. Unconventional Resources Technology Conference, Denver, CO, 22-24 July. URTeC: 123. dx.doi.org/10.15530/urtec-2019-123
8. Nguyen, D., Cramer, D. D., Danielson, T. et al. 2021. Practical Applications of Water Hammer from Hydraulic Fracturing Treatments. Presented at the SPE Hydraulic Fracturing Technology Conference and Exhibition, Virtual, 4-6 May. SPE-204154-MS. https://doi.org/10.2118/204154-MS
9. Roark, A., Waters, G., Ashlee, N. 2017. The Use of Pump Down Pressure Responses to Diagnose Hydraulic Fracture Characteristics. Unconventional Resources Technology Conference, Austin, TX, 24-26 July. URTeC: 2669994. dx.doi.org/10.15530/urtec-2017-2669994
10. Robinson, S., Littleford, T., Luu, T., et al. 2020. Acoustic Imaging of Perforation Erosion in Hydraulically Fractured Wells for Optimizing Cluster Efficiency. SPE Hydraulic Fracturing Technology Conference, The Woodlands, TX, 4-6 February. SPE-199718-MS. dx.doi.org/10.2118/199718-MS
11. Salah, M., Gabry, M., El-Sebaee, M. 2017. Evaluation of Multistage Fracturing Stimulation Horizontal Well Completion Methods in Western Desert, Egypt. SPE Middle East Oil and Gas Conference, Manama, Kingdom of Bahrain, 6-9 March. SPE-183785-MS. dx.doi.org/10.2118/183785-MS
12. Sneddon, I. N. 1946. The Distribution of Stress in the Neighborhood of a Crack in an Elastic Solid. Proc. R. Soc. Lond. A 187 (1009): 229-260.
13. Stonewall Engineering exhibit (FIG. 1). info.stonewall-co.com/stonewall-horizontal-wellstimulation
14. Ugueto, G., Huckabee, P., Molenaar, M., et al. 2016. Perforation Cluster Efficiency of Cemented Plug and Perf Limited Entry Completions; Insights from Fiber Optics Diagnostics. SPE Hydraulic Fracturing Technology Conference, The Woodlands, TX, 9-11 February. SPE-179124-MS. dx.doi.org/10.2118/179124-MS 15. Ugueto, G., Huckabee, P., Wojtaszek, M., et al. 2019. New Near-Wellbore Insights from Fiber Optics and Downhole Pressure Gauge Data. SPE Hydraulic Fracturing Technology Conference, The Woodlands, TX, 5-7 February. SPE 194371-MS. dx.doi.org/10.2118/194371-MS
16. Walker, K., Wutherich, K., Terry, J. 2012. Engineered Perforation Design Improves Fracture Placement and Productivity in Horizontal Shale Gas Wells. Americas Unconventional Resource Conference, Pittsburgh, PA, 5-7 June. SPE 154582. dx.doi.org/10.2118/154582-MS
17. Walton, Z., Nichols, M., Fripp, M. 2019. Frac Plug Pump Down Efficiencies and Techniques. SPE Annual Technical Conference and Exhibition, Calgary, AL, 30 September-2 October. SPE 196210-MS. dx.doi.org/10.2118/196210-MS
18. Weijers, L., Wright, C., Mayerhofer, M., et al. 2019. Trends in the North American Frac Industry: Invention through the Shale Revolution. SPE Hydraulic Fracturing Technology Conference, The Woodlands, TX, 5-7 February. SPE 194345-MS. dx.doi.org/10.2118/194345-MS
19. Weijers, L., de Pater, H., Owens, K., et al. 1994. Geometry of Hydraulic Fractures Induced From Horizontal Wells. SPE Prod & Fac. 9 (02). 87-92. SPE-25049-PA. dx.doi.org/10.2118/25049-PA
20. Wright, C., Minner, W., Weijers, L., et al. (1997). Wellbore-to-Fracture Communication Problems Pose Challenges in California Diatomite Horizontal Wells. SPE Annual Technical Conference and Exhibition, San Antonio, TX, 5-8 October. SPE 38632. dx.doi.org/10.2118/38623-MS
21. Zhang, S., Zhu, D. 2017. Inversion of Downhole Temperature Measurements in Multistage Fracturing Stimulation of Horizontal Wells in Unconventional Reservoirs. SPE Annual Technical Conference and Exhibition, San Antonio, TX, 9-11 October. dx.doi.org/10.2118/187322-MS
22. U.S. Pat. No. 9,988,895. "Method for Determining Hydraulic Fracture Orientation and Dimension." (2018).
23. U.S. Pat. No. 10,408,054. "Method for Estimating Stress Magnitude." (2019).
24. U.S. Pat. No. 10,458,228. "Low Frequency Distributed Acoustic Sensing." (2019).
25. U.S. Pat. No. 10,753,181. "Methods for Shut-In Pressure Escalation Analysis." (2020).
26. U.S. Pat. No. 10,801,307, "Engineered Stress State with Multi-Well Completions." (2020).
27. U.S. Pat. No. 10,808,521. "Hydraulic Fracture Analysis." (2020).
28. U.S. Pat. No. 11,209,558. "Measurement of Poroelastic Pressure Response." (2021).
29. US20180364381. "Stimulated Rock Volume Analysis." (2018).
30. US20190120047. "Low Frequency Distributed Acoustic Sensing Hydraulic Fracture Geometry."(2019).
31. US20190346579. "Ubiquitous Real-Time Fracture Monitoring." (2019).
32. US20200309982. "Machine-Learning Based Fracture-Hit Detection Using Low-Frequency DAS Signal." (2020).

The invention claimed is:

1. A process for testing a wellbore in a hydrocarbon reservoir where the process comprises:

a. providing a wellbore in a hydrocarbon reservoir;

b. running in the wellbore a wireline and a bottomhole assembly (BHA) consisting of a frac plug, a setting tool, multiple perforating guns and a casing collar locator, with a frac ball preinstalled in the frac plug until said BHA reaches a build section of the wellbore;

c. pumping water into the wellbore at a rate of 5-15 bbl/min (0.79-2.4 $m^3$/min) to drag the BHA to a desired location in a lateral wellbore;

d. shutting down to obtain an instantaneous shut in pressure (ISIP) and 3 to 5 minutes of shut-in pressure for establishing a pump-down pressure-falloff trend line;

e. activating the setting tool to set the frac plug;

f. moving wireline up the wellbore to place perforating guns at a first perforating location;

g. pumping at 1-2 bbl/min (0.16-0.32 $m^3$/min) to seat the frac ball in the frac plug, wherein seating said frac ball isolates previously treated intervals and forms a closed wellbore chamber from the frac plug to surface treating lines;

h. increasing pressure in the wellbore to at least 1000 psi (6.9 MPa) above a pump-down shut-in pressure;

i. monitoring pressure for 3 to 5 minutes to check for pressure-tightness of the closed wellbore chamber;

j. checking for indications of fluid bleed-back and make adjustments if necessary to achieve a leak-tight seal;

k. maintaining pressure, selectively perforating a first (toe-ward) cluster interval only and observing pressure falloff response for 3 to 5 minutes;

l. Evaluating for communication with or isolation from the previously treated intervals;

m. moving the wireline up the wellbore to locate the BHA away from the perforations;

n. reopening a plug valve;

o. injecting into the first cluster at an injection rate of 2 bbl/min (0.32 $m^3$/min) until treating pressure stabilizes or breaks back;

p. increasing the injection rate to 5-6 bbl/min (0.79-0.95 $m^3$/min), continuing to pump until pressure re-stabilizes;

q. pumping for at least an additional minute;

r. shutting down to obtain instantaneous shut in pressure (ISIP) and evaluating pressure falloff response for 3-5 minutes;

s. perforating one or more remaining perforation clusters in a frac stage while optionally injecting at a rate of 1-6 bbl/min;

t. discontinuing injection after perforating is complete; and u. retrieving the wireline, setting tool and spent guns and preparing the wellbore for a next frac stage;

v. selectively repeating steps (b) through (v) until all frac stages have been completed; and w. producing hydrocarbons from a treated wellbore.

2. The method according to claim 1, wherein said frac plug is selected from a solid bridge plug, a composite bridge plug, a poppet-type frac plug, a poppet-type frac plug comprising a pre-installed check device, and a retrievable bridge plug.

3. The method according to claim 1, where step(s) includes evaluating for indication of communication with or isolation from the previously treated intervals.

4. The method according to claim 1, wherein inhibited HCl acid is used in conjunction with the pump-down process of step (q) to extend fluid injection until a wireline acid arrives at an open perforation cluster, then discontinuing injection.

5. The method according to claim 1, wherein wireline acid is spotted across one or more perforations.

6. The method according to claim 1, wherein an injection rate of step (q) is increased to maintain a flow velocity through each perforation.

7. The method according to claim 1, wherein an optimized automated hydraulic integrity system is used to adjust integrity analysis parameters in real-time.

* * * * *